US007304624B2

(12) United States Patent
Lee

(10) Patent No.: US 7,304,624 B2
(45) Date of Patent: Dec. 4, 2007

(54) LIQUID CRYSTAL DISPLAY APPARATUS AND METHOD FOR DRIVING THE SAME

(75) Inventor: Seung-Woo Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 703 days.

(21) Appl. No.: 10/761,694

(22) Filed: Jan. 20, 2004

(65) Prior Publication Data

US 2005/0001802 A1 Jan. 6, 2005

(30) Foreign Application Priority Data

Jul. 4, 2003 (KR) ..... 10-2003-0045449

(51) Int. Cl.
*G09G 3/36* (2006.01)

(52) U.S. Cl. ..... 345/89

(58) Field of Classification Search ..... 345/87–92
See application file for complete search history.

(56) References Cited

U.S. PATENT DOCUMENTS 6,825,824 B2 * 11/2004 Lee ..... 345/89
7,071,930 B2 * 7/2006 Kondo et al. ..... 345/204
2003/0193460 A1 * 10/2003 Lee et al. ..... 345/87

* cited by examiner

*Primary Examiner*—Amr A. Awad
*Assistant Examiner*—Steven E Holton
(74) *Attorney, Agent, or Firm*—Cantor Colburn LLP

(57) ABSTRACT

A liquid crystal display apparatus capable of improving response time as well as display quality is provided. The apparatus includes a timing controller to generate a plurality of compensated grayscale data, a memory to store grayscale data or the compensated grayscale data, a column driver to apply the compensated grayscale data to a plurality of data lines, a gate driver to apply a gate signal to a plurality of gate lines, and a liquid crystal panel including the gate lines, the data lines and a plurality of switching element disposed between the data lines and the gate lines.

22 Claims, 18 Drawing Sheets

LIQUID CRYSTAL DISPLAY APPARATUS AND METHOD FOR DRIVING THE SAME

BACKGROUND OF THE INVENTION

1. Field of the Invention

The present invention relates to a liquid crystal display (LCD) apparatus and a method for driving the same, and more particularly, to an LCD apparatus in which at least two overshoot voltages are applied to a pixel electrode in response to a change of grayscale data of a frame to improve a response time as well as display quality and a method for driving the LCD apparatus.

2. Description of the Related Art

LCD apparatuses are thinner and lighter and draw much less power than cathode ray tubes. They are used in laptop computers, mobile phones and many other electronic devices.

Recently, new technologies have been developed to improve the display quality of LCD apparatuses. One of them is a DCC (Dynamic Capacitance Compensation) technology. The DCC technology improves a response speed of LC (Liquid Crystal) molecules by compensating a grayscale voltage of a current frame with a previous grayscale voltage and a current target grayscale voltage.

Another new technology is Patterned Vertical Alignment (PVA). PVA mode LCD apparatuses control the switching behavior of LC (Liquid Crystal) molecules by forming an opening pattern in a pixel electrode (or transparent electrode) or a common electrode or by creating fringe fields, thereby providing a wide view angle.

Although the DCC and PVA technologies improve the display quality of LCD apparatuses, LCD apparatuses still have pattern blinking problems. As LCD apparatuses become larger, the pattern blinking appears more.

FIG. 1 is a graph showing the response time of a PVA mode LCD apparatus before and after performing a DCC method. As shown in an "x" marked line, a rising time is slow at a middle level of grayscale, i.e., until seven or eight frames are passed, when the DCC is not performed. The slow rising time can be improved by performing the DCC, as shown in a "•" marked line. However, there are still problems such as luminance deterioration or appearance of residual images. For example, when PVA mode LCD apparatuses display a motion picture, the motion picture blinks due to the change of luminance.

FIG. 2A is a graph showing the data voltages of a PVA mode LCD apparatus before and after performing a DCC method. FIG. 2B is a graph showing the luminance of a PVA mode LCD apparatus before and after performing a DCC method.

When the DCC method is not performed in PVA mode LCD apparatuses, an arrangement of LC molecules is gradually changed even when a level of grayscale is abruptly changed from a low level to a high level. That is, as shown the "x" marked lines of FIG. 2A and 2B, the arrangement of LC molecules corresponding to the high level of grayscale is completed after two or three frames have passed and a luminance is gradually increased. Although, as shown in the "•" marked lines of FIGS. 2A and 2B, the LC molecules are arranged rapidly, that is, the response time is reduced, by performing the DCC method, the luminance of PVA mode LCD apparatus drops again after temporarily increasing, because the LC molecules tends to return to an original arrangement. Thus, LCD apparatuses have pattern blinking, resulting in deteriorating display quality.

SUMMARY OF THE INVENTION

The present invention provides a liquid crystal display apparatus capable of reducing response time as well as improving display quality.

The present invention provides a driving device of a liquid crystal display apparatus capable of improving display quality.

The present invention further provides a method for driving a liquid crystal display apparatus in which pattern blinking is prevented and response time is reduced.

According to one aspect of the present invention, a liquid crystal display apparatus, comprises a timing controller to generate a plurality of compensated grayscale data; a memory to store grayscale data or the compensated grayscale data; a column driver to apply the compensated grayscale data to a plurality of data lines; a gate driver to apply a gate signal to a plurality of gate lines; and a liquid crystal panel including the gate lines, the data lines and a plurality of switching element disposed between the data lines and the gate lines.

According to another aspect of the present invention, a method for driving a liquid crystal display apparatus, comprises generating first compensated grayscale data in response to grayscale data for a current frame and previously stored grayscale data for a previous frame; generating second compensated grayscale data in response to the first compensated grayscale data and the grayscale data for the current frame; generating third compensated grayscale data in response to the first compensated grayscale data and previously stored compensated grayscale data; storing the grayscale data for the current frame and the second compensated grayscale data; applying a gate signal to gate lines; and applying a data voltage corresponding to the third compensated grayscale data to data lines.

According to further aspect of the present invention, A method for driving a liquid crystal display apparatus, comprises generating first compensated grayscale data in response to grayscale data for a current frame and previously stored grayscale data for a previous frame; generating second compensated grayscale data in response to the first compensated grayscale data and previously stored compensated grayscale data; generating third compensated grayscale data in response to the second compensated grayscale data and the grayscale data for the current frame; storing the grayscale data for the current frame and the third compensated grayscale data; applying a gate signal to gate lines; and applying a data voltage corresponding to the second compensated grayscale data to data lines.

This application claims a priority upon Korean Patent Application No.2003-45449 filed on Jul. 4, 2003, the contents of which are herein incorporated by reference in its entirety.

BRIEF DESCRIPTION OF THE DRAWINGS

The above and other features and advantages of the present invention will become more apparent by describing in detail the preferred embodiments thereof with reference to the accompanying drawings, in which.

DETAILED DESCRIPTION OF THE INVENTION

Hereinafter, the exemplary embodiments of the present invention will be described in detail with reference to the accompanying drawings.

Figure 1:
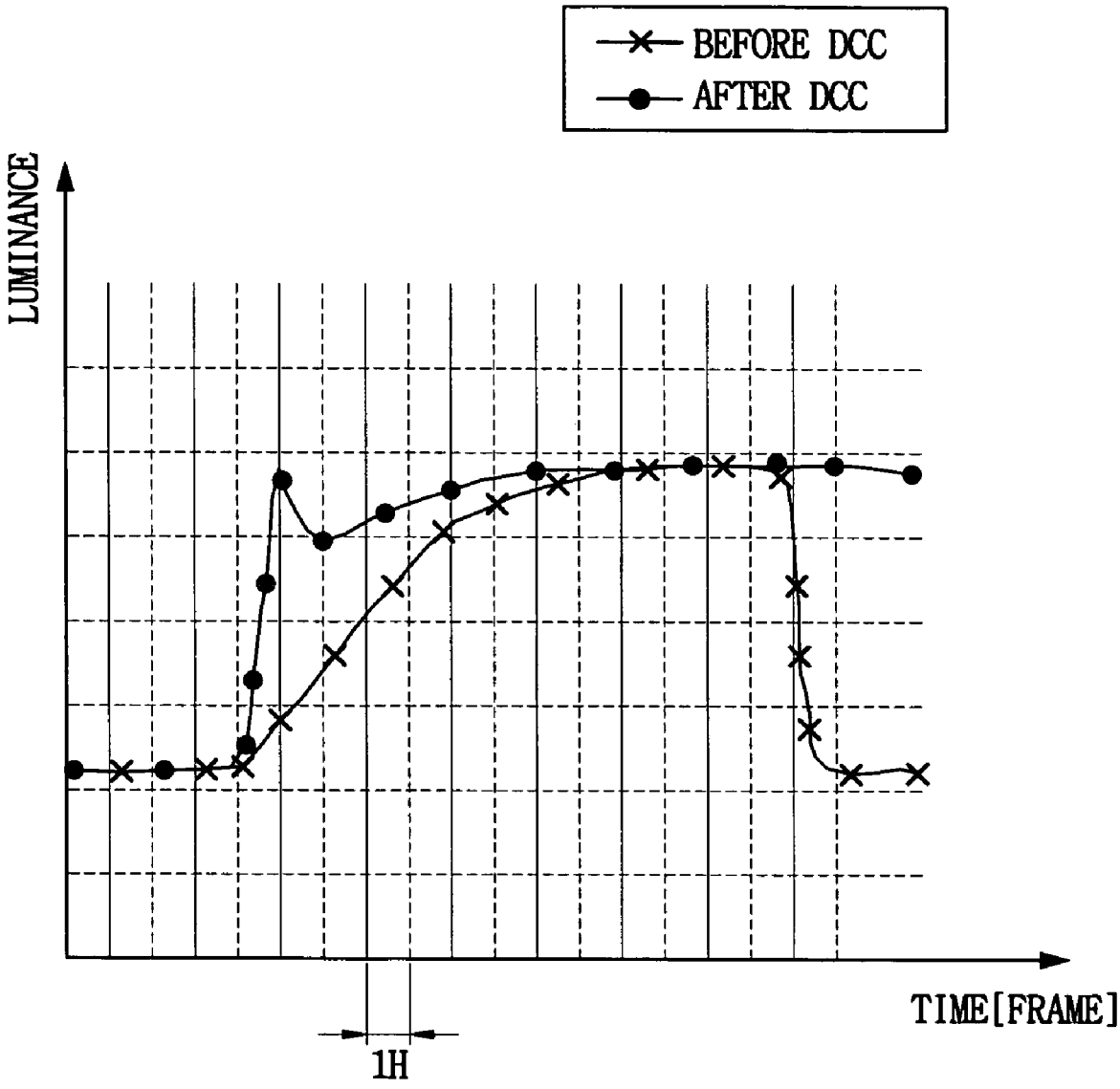
FIG. 1 (PRIOR ART)
FIG. 1 is a graph showing the response time of a PVA mode LCD apparatus before and after performing DCC.
Figure 2A:
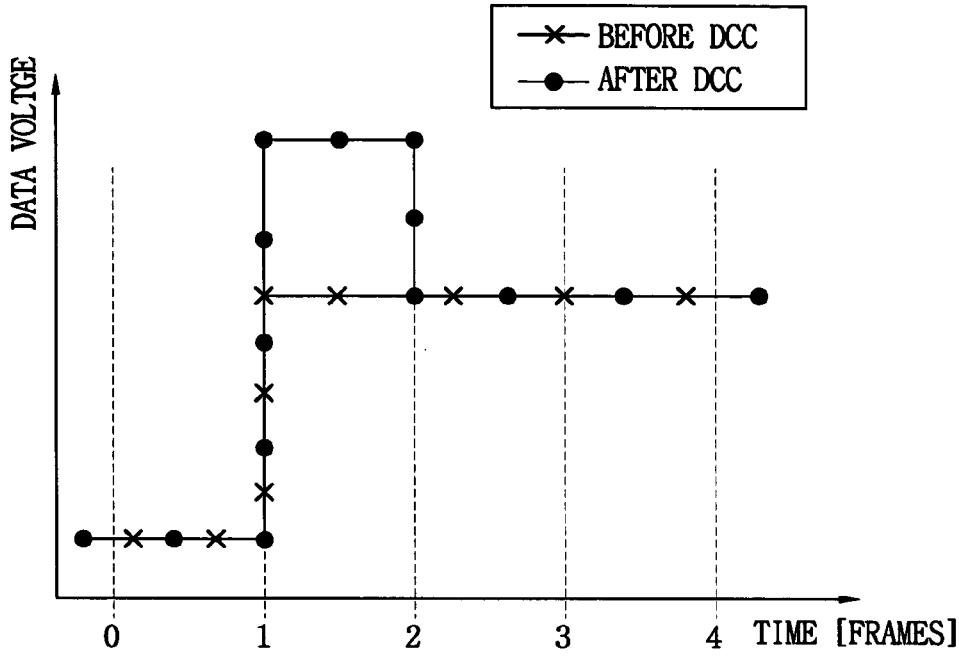
FIG. 2A (PRIOR ART)
FIGS. 2A and 2B are graphs showing the data voltage and luminance of a PVA mode LCD apparatus before and after performing DCC, respectively.
Figure 2B:
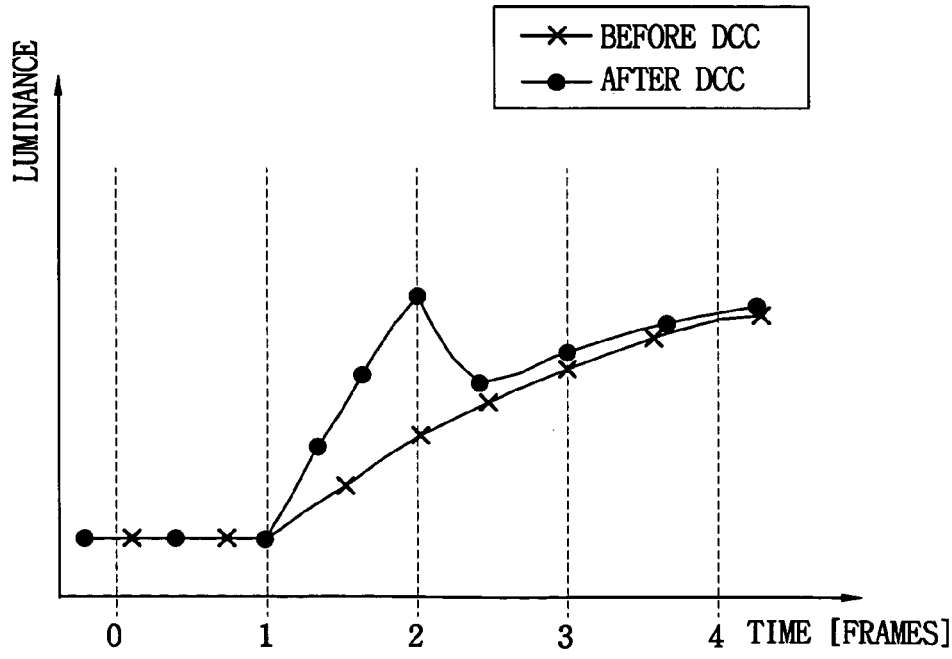
FIG. 2B (PRIOR ART)
Figure 3:
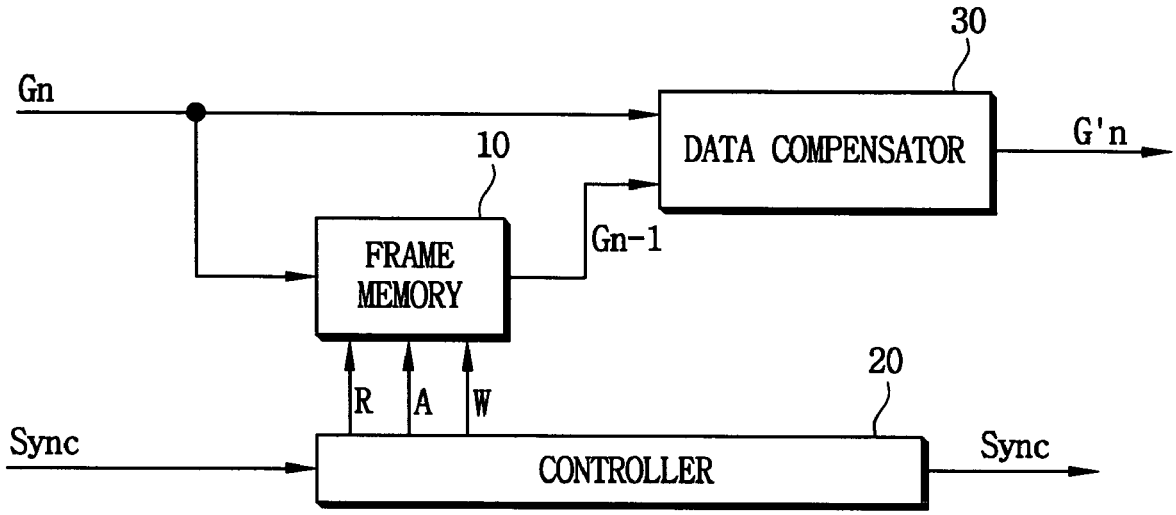
FIG. 3 is a block diagram for illustrating a DCC method.

FIG. 3 is a block diagram for illustrating a DCC method. The grayscale data for one frame is stored in a frame memory 10. A controller 20 applies a read instruction 'R', a write instruction 'W' and an address instruction 'A' to the frame memory 10 so as to control the frame memory 10. A data compensator 30 generates the compensated grayscale data (or a compensated data voltage) G'n of a current frame by using the grayscale data (or a grayscale voltage) Gn of the current frame and the grayscale data Gn-1 of a previous frame, which is previously stored in the frame memory 10.

When a target pixel voltage of the current frame is higher than the pixel voltage of the previous frame, the pixel voltage of the current frame is compensated to be higher than the target pixel voltage. The target pixel voltage of the current frame is applied to the pixels of a next frame. A value of the compensated voltage depends on the capacitance determined by the pixel voltage of the previous frame.

Figure 4:
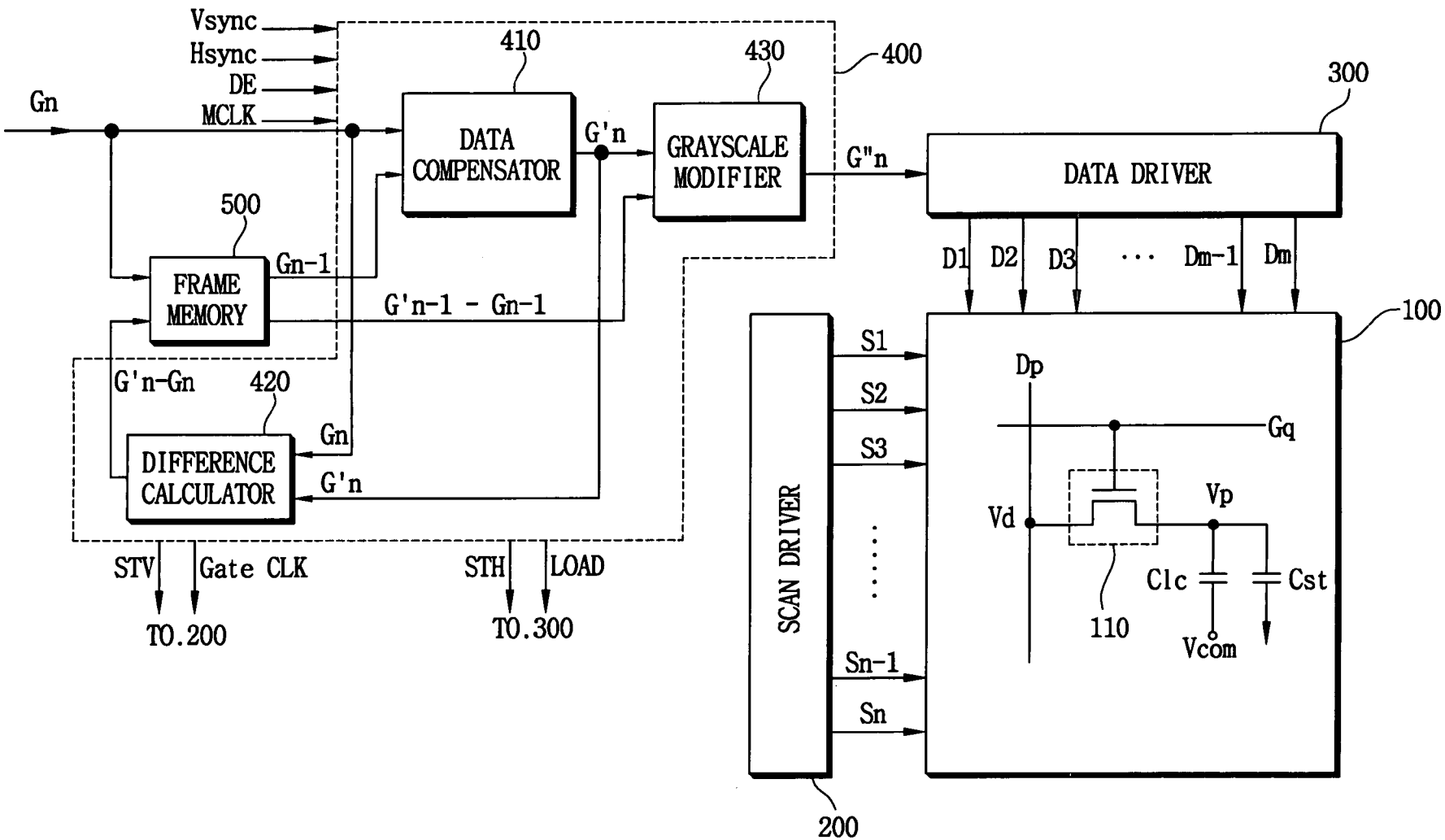
FIG. 4 is a block diagram of an LCD apparatus according to an exemplary embodiment of the present invention.

FIG. 4 is a block diagram of an LCD apparatus according to an exemplary embodiment of the present invention. Referring to FIG. 4, an LCD apparatus includes a LC panel 100, a scan driver 200, a data driver 300, a timing controller 400 and a frame memory 500. The timing controller 400 receives grayscale data from an external device such as a graphic controller (not shown), and generates and applies the compensated grayscale data of the grayscale data to the data driver 300. The timing controller 400 receives first signals Vsync, Hsync, DE and MCLK, and applies second signals STV and Gate CLK and third signals STH and LOAD to the scan driver 200 and the data driver 300, respectively. The scan and data drivers 200 and 300 drive the LC panel 100 to display images.

The timing controller 400 includes a data compensator 410, a difference calculator 420 and a grayscale modifier 430. The timing controller 400 generates the second compensated grayscale data G"n of a current frame by using the difference between the grayscale data Gn-1 of a previous frame and the grayscale data Gn of the current frame and the difference between the grayscale data Gn-1 of the previous frame and the compensated grayscale data G'n-1 of the previous frame. The difference between the grayscale data Gn-1 of the previous frame and the grayscale data Gn of the current frame is the first compensated grayscale data Gn' of the current frame. The compensated grayscale data G'n-1 of the previous frame is generated by using the grayscale data Gn-1 of the previous frame and the grayscale data Gn-2 of a previous frame. The second compensated grayscale data G'n of the current frame is applied to the data driver 300.

The frame memory 500 receives and stores the grayscale data of one frame from an external device (not shown) and the data difference of one frame from the difference calculator 420. For example, the frame memory 500 receives and stores the grayscale data Gn of a current frame from the external device and provides the data compensator 410 with the previously stored grayscale data Gn-1 of a previous frame, in response to a control signal of a controller (not shown). Further, the frame memory 500 receives and stores the data difference G'n−Gn from the difference calculator 420 and provides the grayscale modifier 430 with the previously stored data difference G'n-1−Gn-1. The frame memory 500, for example, includes a synchronous dynamic random access memory (SDRAM) which outputs stored data in response to the input of data or Double Data Rate (DDR) memory.

The data compensator 410 receives the grayscale data Gn of the current frame from the external device and the stored grayscale data Gn-1 of the previous frame from the frame memory 500 to generate the first compensated grayscale data G'n of the current frame. The first compensated grayscale data G'n includes overshoot data or undershoot data. The first compensated grayscale data G'n of the current frame is transferred to the grayscale modifier 430 and the difference calculator 420. The data compensator 410, for example, includes a LUT (look-up table).

The difference calculator 420 generates the data difference G'n−Gn by using the first compensated grayscale data G'n of the current frame and the grayscale data Gn of the current frame. The difference calculator 420 provides the frame memory 500 with the data difference G'n−Gn.

The grayscale modifier 430 generates the second compensated grayscale data G"n by using the first compensated grayscale data G'n and the data difference (G'n-1)−(Gn-1) of the previous frame. The second compensated grayscale data G"n is applied to the data driver 300 so that a data voltage is greater or less than a target pixel voltage during the variation of grayscale. Thus, the response time of LC molecules is optimized.

For example, when the grayscale data Gn-1 of the previous frame is the substantially same as the grayscale data Gn of the current frame, the grayscale data Gn of the current frame is not compensated. When the grayscale data Gn-1 of the previous frame has a lower level than that of the grayscale data Gn of the current frame, for example, the grayscale data Gn-1 of the previous frame is a black color and the grayscale data Gn of the current frame is a white color, the timing controller 400 outputs the second compensated grayscale data G"n that is higher than the grayscale data Gn of the current frame. Thus, the timing controller 400 outputs the second compensated grayscale data G"n as overshoot waveform using the grayscale data Gn-1 of the previous frame and the grayscale data Gn of the current frame.

The timing controller 400 minimizes the number of frame memories as well as optimizes the response time of LC molecules. Assume that each grayscale of red color, green color and blue color is 8-bit data (that is, the total bits of grayscale is 24 bits) and the frame memory 500 has a 32-bit data bus. In this case, the frame memory 500 has 8-bit as a surplus, and stores the data difference G'n−Gn as an 8-bit. Thus, a process time is reduced.

For example, when each grayscale data of red color, green color and blue color is x-bit data, the data difference G'n−Gn of each color is y-bit data (wherein y is an integer smaller than x). If the data difference G'n−Gn of the RGB is 8-bit data, the combination of the data difference G'n−Gn of the RGB includes, for example, 8-bit of (3, 3, 2), (3, 2, 3) or (2, 3, 3). The data difference G'n−Gn of the current frame corresponds to a most significant bit (MSB). Therefore, the timing controller 400 generates the second compensated grayscale data G"n by using one frame memory 500, which stores the grayscale data in one portion and stores the data difference in a remaining portion. Thus, the response time of the LC molecules is enhanced with the minimized number of the frame memories.

The timing controller 400 is implemented in a single unit or is integrally formed with an external (not shown) or the data driver 300. The data driver 300 applies the data voltage, which is adjusted according to the compensated grayscale data G"n, to the pixel of the LC panel 100. Thus, the response time of LC molecules is improved without modifying the LC panel 100 or the physical property of LC molecules, resulting in improving of the display quality of an LCD apparatus.

The LC panel 100 includes a plurality of gate lines (or scan lines) Gq for receiving gate-on signals from the scan driver 200, a plurality of data lines (or source lines) Dp for receiving compensated data voltages from the data driver 300 and the pixels defined by the gate lines Gq and the data lines Dp. Each of the pixels includes a thin film transistor 110 having gate and source electrodes respectively connected to the gate line Gq and the data line Dp, a liquid crystal capacitor Clc connected to the drain electrode of the thin film transistor 110 and a storage capacitor Cst. The LC panel 100 includes TN (Twist Nematic) mode LC molecules or PVA (Patterned Vertical Alignment) mode LC molecules.

The scan driver section 200 applies the gate-on signals S1, S2, S3, . . . , Sn to the gate lines Gq in sequence so as to turn on the thin film transistor 110 that is electrically connected to the gate lines Gq. The scan driver section 200 is, for example, formed with a printed circuit board or a flexible printed circuit (FPC). Alternatively, the scan driver section 200 may include a shift register having plurality of stages, each output terminal being electrically connected to the gate line Gq, formed on the same substrate on which the thin film transistor 110 is formed.

The data driver 300 receives the second compensated grayscale data Gn" from the timing controller 400, and transforms the second compensated grayscale data Gn" into data signals D1, D2, . . . , Dm. The data signals D1, D2, . . . , Dm are applied to each of the data lines Dp.

Figure 5A:
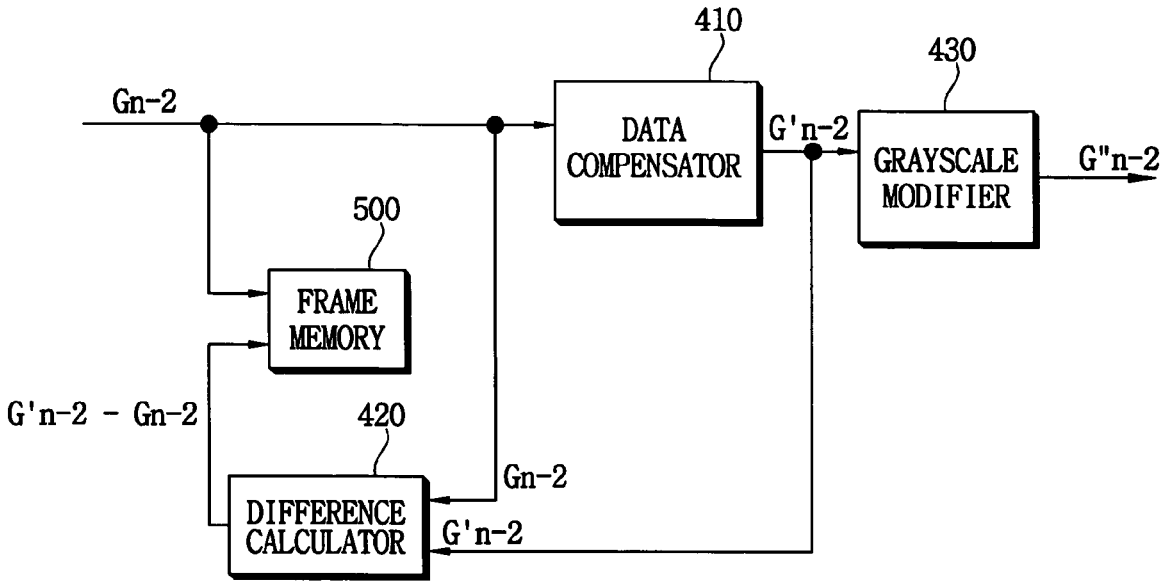
FIGS. 5A through 5C are block diagrams showing an operation of the timing controller of FIG. 4.
Figure 5B:
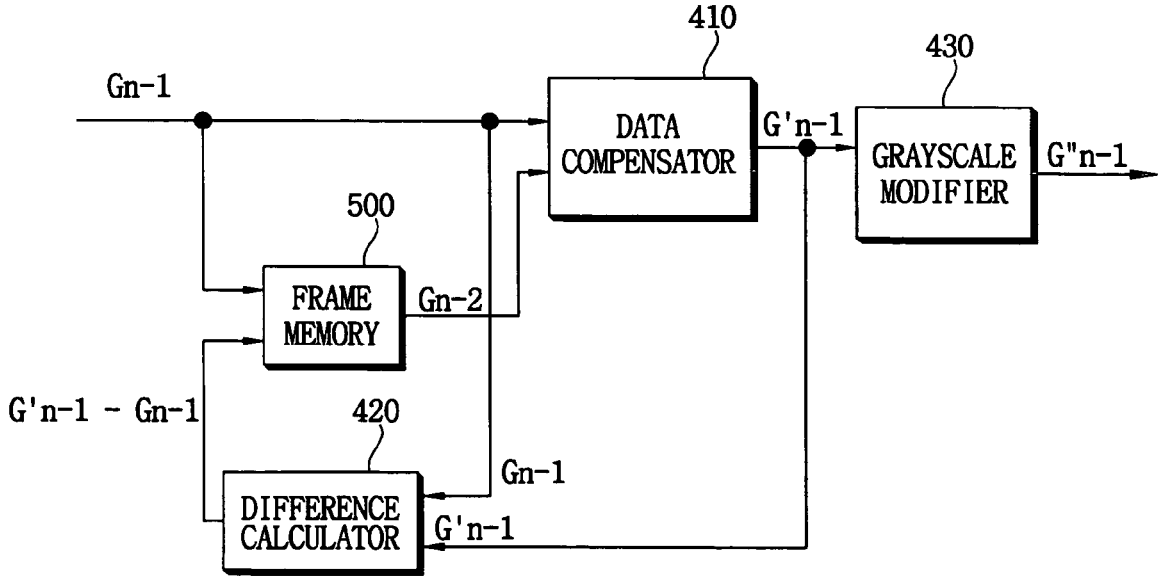
Figure 5C:
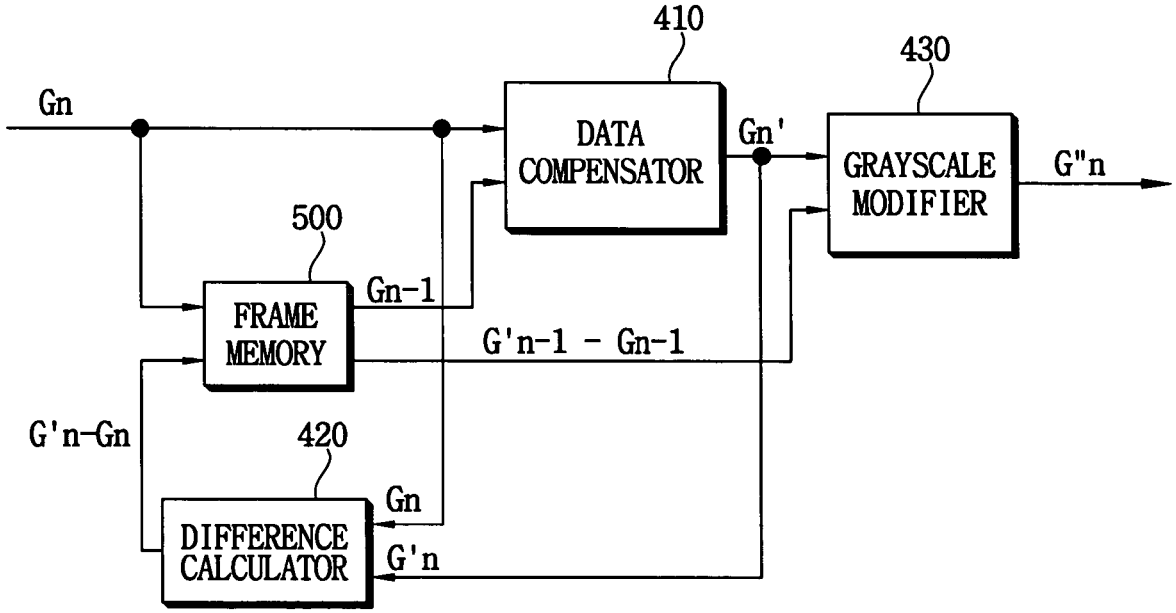

FIGS. 5A to 5C are block diagrams showing an operation of the timing controller of FIG. 4. Referring to FIG. 5A, when the grayscale data Gn-2 of a (n-2)-th frame is applied to a frame memory 500 and a data compensator 410, the data compensator 410 generates first compensated grayscale data G'n-2 of the (n-2)-th frame. The data compensator 410 provides the grayscale modifier 430 and a difference calculator 420 with the first compensated grayscale data G'n-2. The first compensated grayscale data G'n-2 is not compensated or is the same as the grayscale data Gn-2.

The difference calculator 420 receives the grayscale data Gn-2 of the (n-2)-th frame and the first compensated grayscale data G'n-2 of the (n-2)-th frame. The difference calculator 420 calculates the data difference (G'n-2)−(Gn-2). The difference calculator 420 provides the frame memory 500 with the data difference (G'n-2)−(Gn-2). The frame memory 500 stores the data difference (G'n-2)−(Gn-2).

The grayscale modifier 430 receives the first compensated grayscale data G'n-2 and generates second compensated grayscale data G"n-2. The second compensated grayscale data G"n-2 is the same as the grayscale data Gn-2. Thus, the grayscale data Gn-2 is not compensated at the (n-2)-th frame.

Referring to FIG. 5B, when the grayscale data Gn-1 of a (n-1)-th frame is applied to the frame memory 500 and the data compensator 410, the frame memory 500 provides the data compensator 410 with the stored grayscale data Gn'-2 of the (n-2)-th frame. The data compensator 410 generates the first compensated grayscale data G'n-1 of the (n-1)-th frame using the grayscale data Gn-1 and the grayscale data Gn-2. The data compensator 410 provides the grayscale modifier 430 and the difference calculator 420 with the first compensated grayscale data G'n-1.

The difference calculator 420 receives the grayscale data Gn-1 of the (n-1)-th frame and the first compensated grayscale data G'n-1 of the (n-1)-th frame. The difference calculator 420 calculates the data difference (G'n-1)−(Gn-1). The difference calculator 420 provides the frame memory 500 with the data difference (G'n-1)−(Gn-1). The frame memory 500 stores the data difference (G'n-1)−(Gn-1).

The grayscale modifier 430 receives the first compensated grayscale data G'n-1 and generates second compensated grayscale data G"n-1. The second compensated grayscale data G"n-1 is the same as the first compensated grayscale data Gn'-1.

Referring to FIG. 5C, when the grayscale data Gn of an n-th frame is applied to the frame memory 500 and the data compensator 410, the frame memory 500 provides the data compensator 410 with the stored grayscale data Gn-1 of the (n-1)-th frame. The data compensator 410 generates the first compensated grayscale data G'n of the n-th frame using the grayscale data Gn and the grayscale data Gn-1. The data compensator 410 provides the grayscale modifier 430 and the difference calculator 420 with the first compensated grayscale data G'n.

The difference calculator 420 receives the grayscale data Gn of the n-th frame and the first compensated grayscale data G'n of the n-th frame. The difference calculator 420 calculates the data difference G'n−Gn. The difference calculator 420 provides the frame memory 500 with the data difference G'n−Gn. The frame memory 500 stores the data difference G'n−Gn and provides the grayscale modifier 430 with the stored data difference (G'n-1)−(Gn-1).

The grayscale modifier 430 receives the first compensated grayscale data G'n and the data difference (G'n-1)−(Gn-1). The grayscale modifier 430 generates the second compensated grayscale data G"n using the first compensated grayscale data G'n and the data difference (G'n-1)−(Gn-1). The second compensated grayscale data G"n is provided to the data driver 300.

Figure 6:
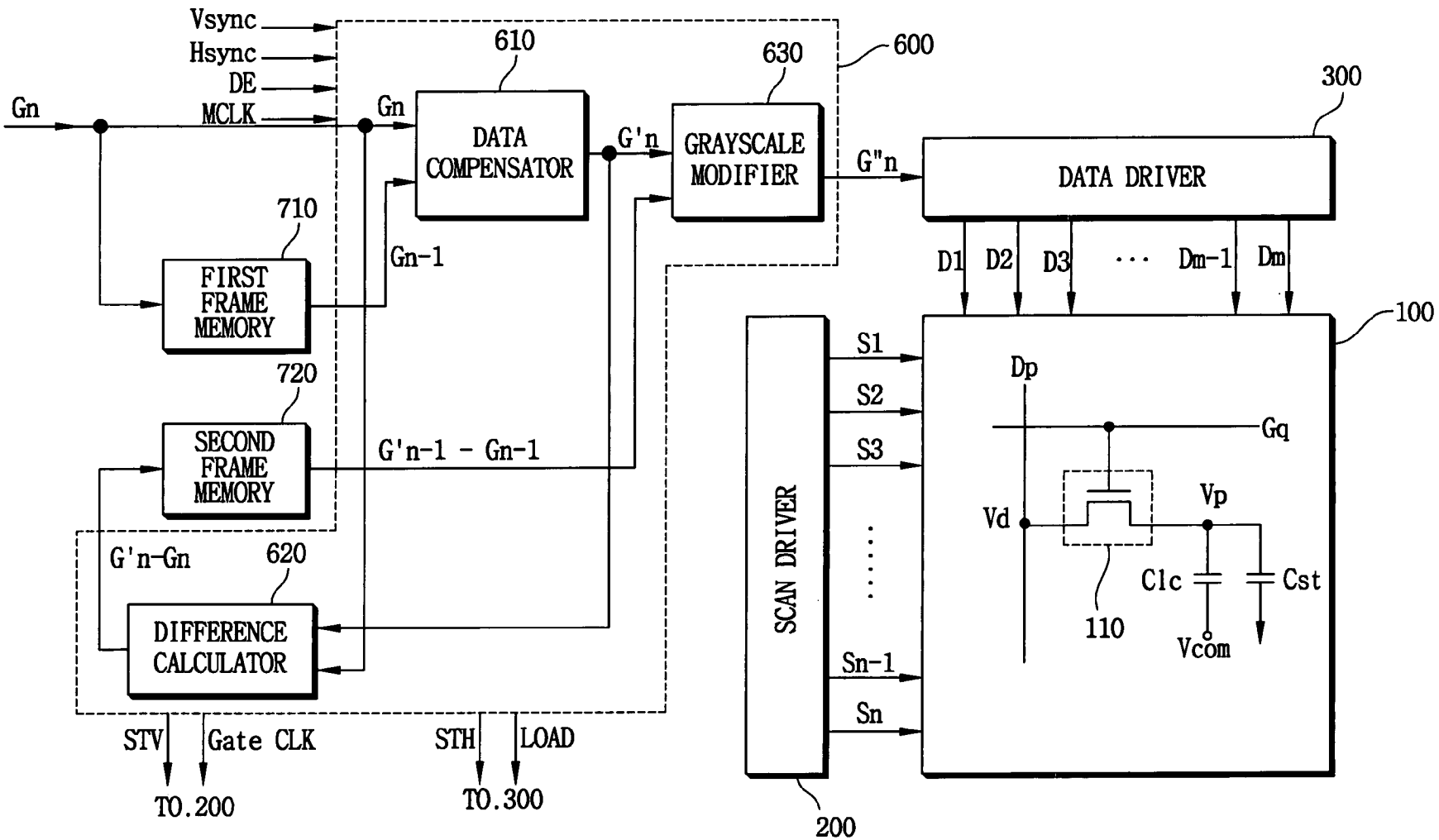
FIG. 6 is a block diagram of an LCD apparatus according to another exemplary embodiment of the present invention.

FIG. 6 shows a block diagram of an LCD apparatus including two frame memories. The same reference numerals are used to refer the same or like parts those described in FIG. 6 and any further explanation is omitted.

Referring to FIG. 6, an LCD apparatus includes an LC panel 100, a scan driver 200, a data driver 300, a timing controller 600, a first frame memory 710, and a second frame memory 720. The timing controller 600 receives first timing signals 'Vsync', 'Hsync', 'DE' and 'MCLK', and it provides the scan driver 200 with second timing signals 'Gate CLK' and 'STV' and the data driver 300 with third timing signals 'LOAD' and 'STH'. The timing controller 600 includes a data compensator 510, a difference calculator 620 and a grayscale modifier 630.

In response to the grayscale data Gn of a current frame, the timing controller 600 generates the first compensated grayscale data Gn' of the current frame by using the difference between the grayscale data Gn of the current frame and the grayscale data Gn-1 of a previous frame. The first compensated grayscale data Gn' is used to generate data difference G'n−Gn. The timing controller 600 generates the second compensated grayscale data G"n of the current frame using the first compensated grays scale data G'n and the difference between the grayscale data Gn-1 of the previous frame and the compensated grayscale data G'n-1 of the previous frame. The compensated grayscale data G'n-1 of the previous frame is generated by using the grayscale data Gn-1 of the previous frame and the grayscale data Gn-2 of a previous frame. The second compensated grayscale data G"n is transferred to the data driver 300.

When the grayscale data Gn-1 of the previous frame is the substantially same as the grayscale data Gn of the current frame, the grayscale data Gn is not compensated. When the grayscale data Gn-1 of the previous frame has a lower level (for example, a black color) than the level (for example, a white color) of the grayscale data Gn of the current frame, the grayscale data Gn is compensated to be greater than the grayscale data Gn-1.

The first frame memory 710 receives and stores the grayscale data Gn of the current frame. The first frame memory 710 provides the data compensator 610 with the previously stored grayscale data Gn-1 of the previous frame in response to a control signal of a controller (not shown). The first frame memory 710 includes, for example, a synchronous dynamic random access memory (SDRAM), which outputs the stored grayscale data Gn-1 of the previous frame in response to the input of the grayscale data Gn of the current frame or DDR memory.

The second frame memory 720 receives and stores the data difference G'n−Gn from the difference calculator 620. The second frame memory 720 provides the grayscale modifier 630 with the previously stored data difference (G'n-1)−(Gn-1) of the previous frame. The second frame memory 720 includes, for example, a SDRAM, which outputs the data difference (G'n-1)−(Gn-1) in response to the input of the data difference G'n−Gn.

The data compensator 610 receives the grayscale data Gn of the current frame and the grayscale data Gn-1 of the previous frame. The data compensator 610 generates the first compensated grayscale data G'n by using the grayscale data Gn and the grayscale data Gn-1. The first compensated grayscale data G'n is transferred to the difference calculator 620 and the grayscale modifier 630.

The difference calculator 620 receives the first compensated grayscale data G'n and the grayscale data Gn. The difference calculator 620 generates the data difference G'n−Gn between the first compensated grayscale data G'n and the grayscale data Gn. The data difference G'n−Gn is transferred to the second frame memory 720. The second frame memory 720 stores the data difference G'n−Gn and provides the grayscale modifier 630 with the data difference (G'n-1)−(Gn-1).

The grayscale modifier 630 receives the first compensated grayscale data G'n and the data difference (G'n-1)−(Gn-1). The grayscale modifier 630 generates the second compensated grayscale data G"n by using the first compensated grayscale data G'n and the data difference (G'n-1)−(Gn-1). The second compensated grayscale data G"n is transferred to the data driver 300.

Figure 7A:
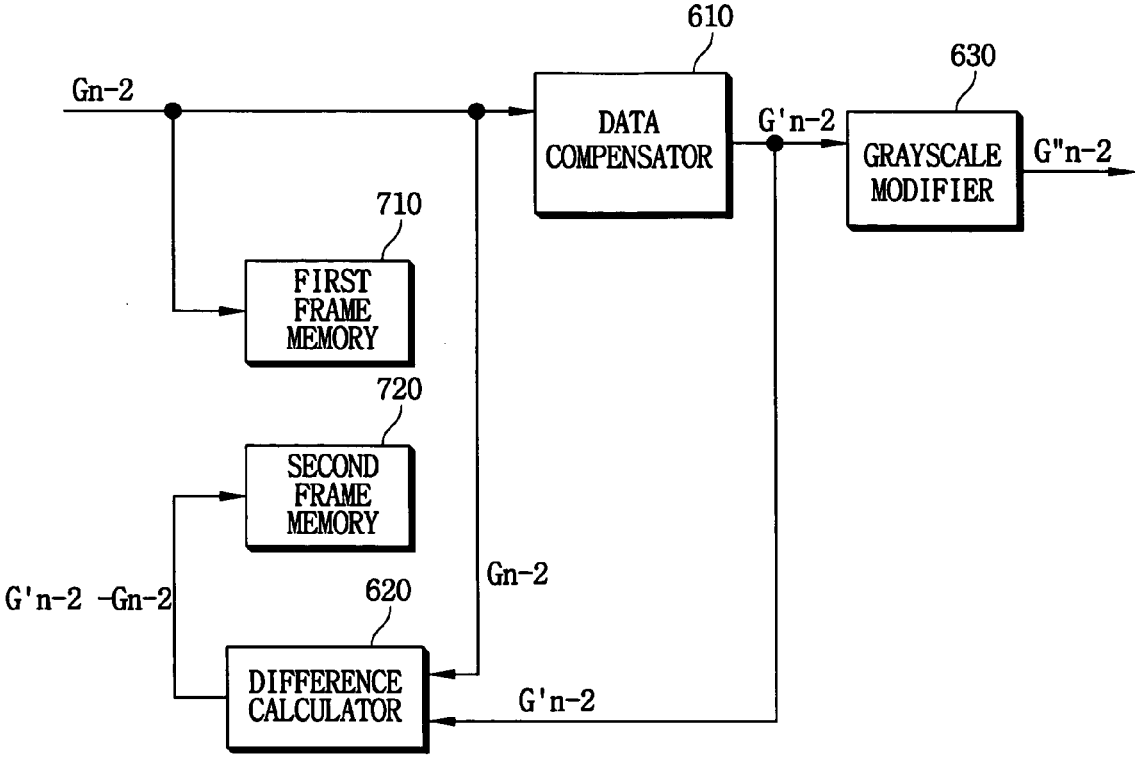
FIGS. 7A through 7C are block diagrams showing an operation of the timing controller of FIG. 6.
Figure 7B:
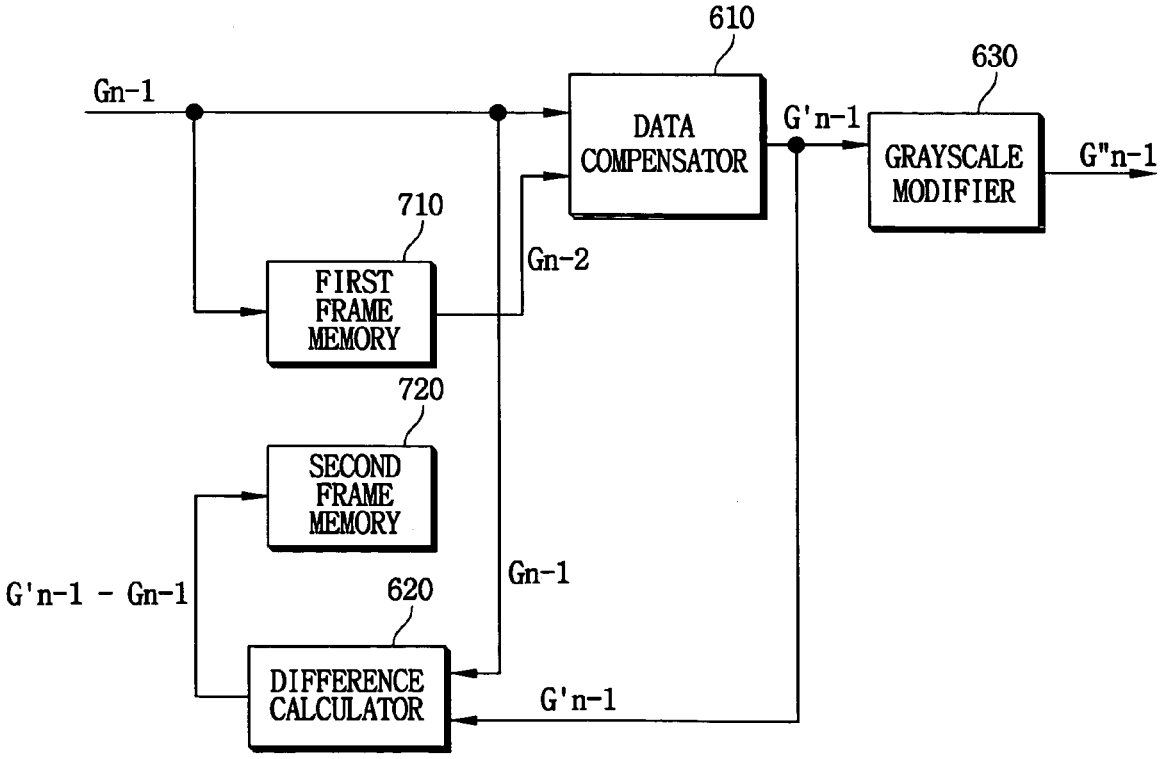
Figure 7C:
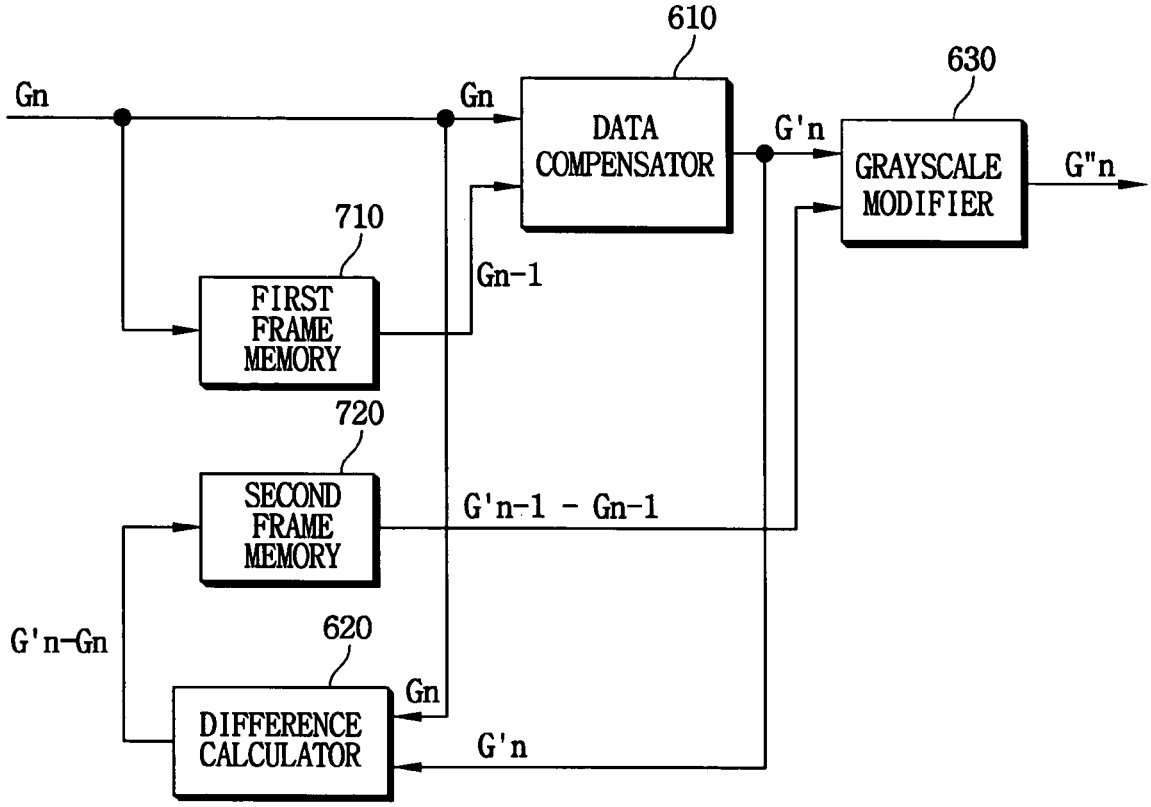

FIGS. 7A to 7C are block diagrams showing an operation of a timing controller of FIG. 6. Referring to FIG. 7A, the grayscale data Gn-2 of a (n-2)-th frame is applied to a first frame memory 710 and a data compensator 610 from an external device. The data compensator 610 generates and provides the first compensated grayscale data G'n-2 of the (n-2)-th frame to the grayscale modifier 630 and a difference calculator 620. The first compensated grayscale data G'n-2 is the same as the grayscale data Gn-2.

The difference calculator 620 receives the grayscale data Gn-2 of the (n-2)-th frame from the external device and the first compensated grayscale data G'n-2 of the (n-2)-th frame from the data compensator 610. The difference calculator 620 calculates the data difference (G'n-2)−(Gn-2), which is provided to a second frame memory 720. The second frame memory 720 stores the data difference (G'n-2)−(Gn-2).

The grayscale modifier 630 receives the first compensated grayscale data G'n-2 and generates second compensated grayscale data G"n-2. The second compensated grayscale data G"n-2 is the same as the grayscale data Gn-2. The grayscale data Gn-2 is not compensated at the (n-2)-th frame.

Referring to FIG. 7B, the grayscale data Gn-1 of a (n-1)-th frame is applied to the first frame memory 710 and the data compensator 610 from the external device. The first frame memory 710 provides the data compensator 610 with the stored grayscale data Gn-2 of the (n-2)-th frame. The data compensator 610 generates the first compensated grayscale data G'n-1 of the (n-1)-th frame by using the grayscale data Gn-1 and the grayscale data Gn-2. The data compensator 610 provides the grayscale modifier 630 and the difference calculator 620 with the first compensated grayscale data G'n-1.

The difference calculator 620 receives the grayscale data Gn-1 of the (n-1)-th frame from the external device and the first compensated grayscale data G'n-1 of the (n-1)-th frame from the data compensator 610. The difference calculator 620 calculates the data difference (G'n-1)−(Gn-1), which is provided to a second frame memory 720. The second frame memory 720 stores the data difference (G'n-1)−(Gn-1).

The grayscale modifier 630 receives the first compensated grayscale data G'n-1 and generates second compensated grayscale data G"n-1. The compensated grayscale data G"n-1 is the same as the first compensated grayscale data Gn'-1.

Referring to FIG. 7C, the grayscale data Gn of an n-th frame is applied to the first frame memory 710 and the data compensator 610 from the external device. The first frame memory 710 provides the data compensator 610 with the stored grayscale data Gn-1 of the (n-1)-th frame. The data compensator 610 generates the first compensated grayscale data G'n of the n-th frame by using the grayscale data Gn and the grayscale data Gn-1. The data compensator 610 provides the grayscale modifier 630 and the difference calculator 620 with the first compensated grayscale data G'n.

The difference calculator 620 receives the grayscale data Gn of n-th frame from the external device and the first compensated grayscale data G'n of n-th frame from the data compensator 610. The difference calculator 620 calculates the data difference G'n−Gn. The difference calculator 620 provides the second frame memory 720 with the data difference G'n−Gn. The second frame memory 720 stores the data difference G'n−Gn, and provides the grayscale modifier 630 with the stored data difference (G'n-1)−(Gn-1).

The grayscale modifier 630 receives the first compensated grayscale data G'n and the data difference (G'n-1)−(Gn-1). The grayscale modifier 630 generates the second compensated grayscale data G"n by using the first compensated grayscale data G'n and the data difference (G'n-1)−(Gn-1). The second compensated grayscale data G"n is provided to the data driver 300.

Since the data voltage compensated according to the second compensated grayscale data G"n is applied to the pixel electrode of the LC panel 100, a response time of LC molecules is enhanced. Further, since the LCD apparatus employs the separate frame memory for storing complete data difference, for example, the second frame memory 720, the LCD apparatus may use a larger amount of the data difference G'n−Gn in compensating the grayscale data, thereby more minutely compensating the grayscale data.

Figure 8A:
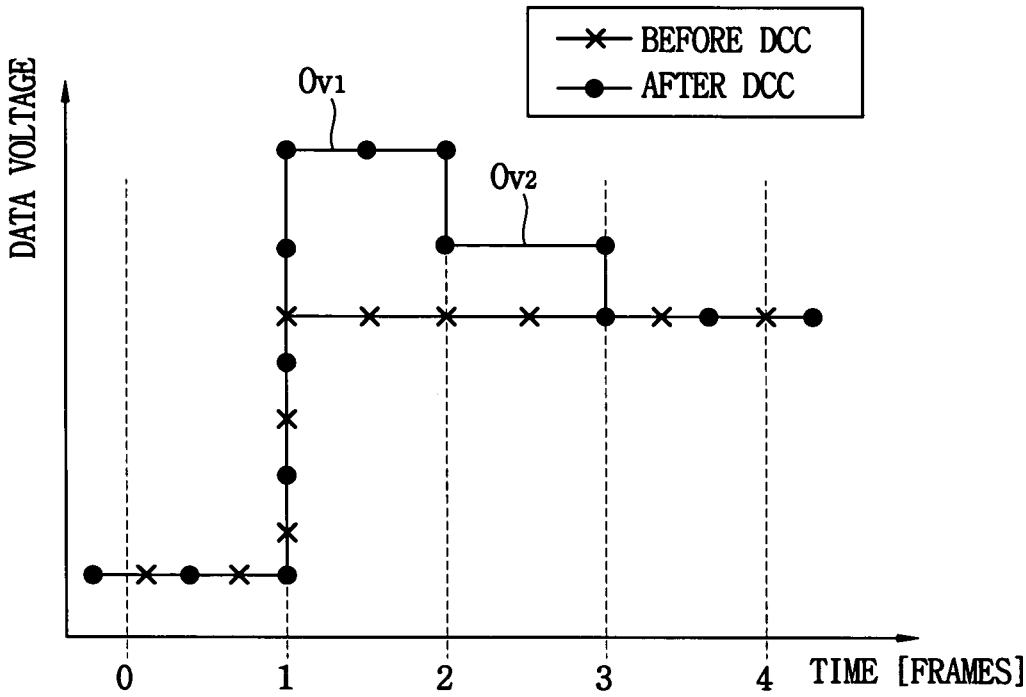
FIG. 8A is a graph showing the data voltage of an LCD apparatus before and after performing DCC, according to an exemplary embodiment of the present invention.
Figure 8B:
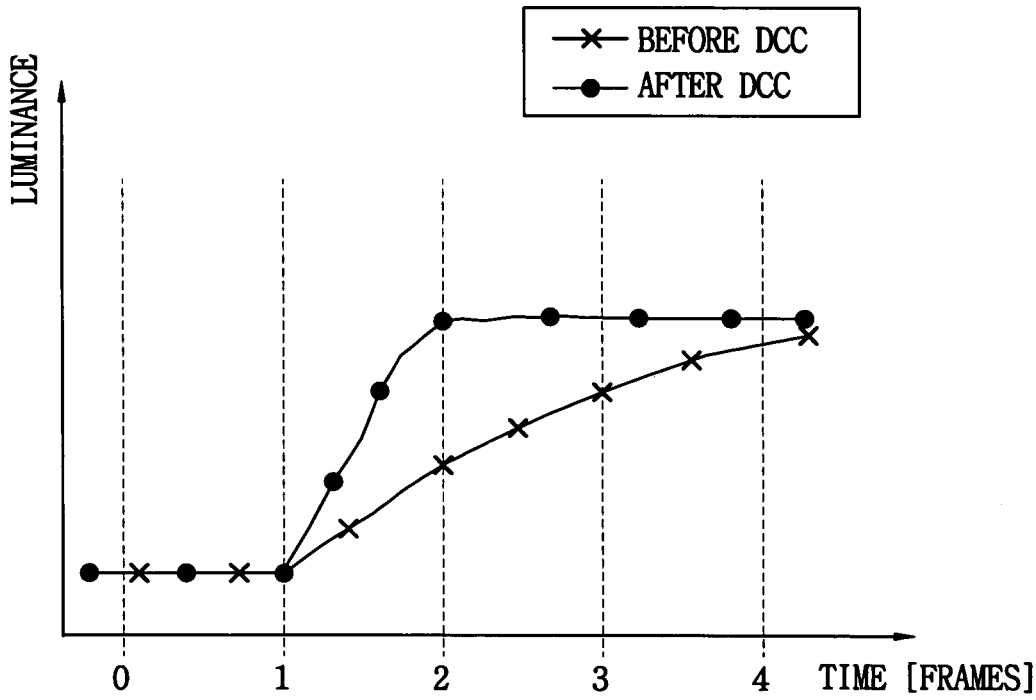
FIG. 8B is a graph showing the luminance of an LCD apparatus before and after performing DCC, according to an exemplary embodiment of the present invention.

FIG. 8A is a graph showing the data voltages of an LCD apparatus before and after performing DCC, according to an exemplary embodiment of the present invention. FIG. 8B is a graph showing the luminance of an LCD apparatus before and after performing DCC, according to an exemplary embodiment of the present invention. The "x" marked lines in FIGS. 8A and 8B illustrate the data voltage and luminance of the LCD apparatus performing no DCC, and the "•" marked lines in FIGS. 8A and 8B illustrate the data voltage and luminance of the LCD apparatus performing DCC according to the present invention.

When the grayscale data of pixel frames is changed from a low level to a high level in the LCD apparatus performing no DCC, as shown in the "x" marked lines, the data voltage arrives at the desired level after two or three frames have passed and the luminance gradually increases. Thus, a response time is slow and residual image appears in the LCD apparatus.

However, when the level of the grayscale data is changed in the LCD performing DCC according to the present invention, as shown in the "•" marked lines, the luminance does not drop because two overshoot voltages Ov1 and Ov2 are continuously applied to at least two frames. Particularly, the first overshoot data voltage Ov1, which is the difference between the grayscale data of the first and second frames, is applied to a pixel electrode during a second frame. Then the second overshoot data voltage Ov2, which is the difference between the first overshoot data voltage Ov1 and the grayscale data of the second frame, is applied to a pixel electrode during a third frame. Thus, the first overshoot data voltage Ov1 rearranges LC molecules rapidly and the second overshoot data voltage Ov2 prevents the LC molecules from returning to an original arrangement. As a result, a luminance arrives at a desired level at the first frame.

Figure 9:
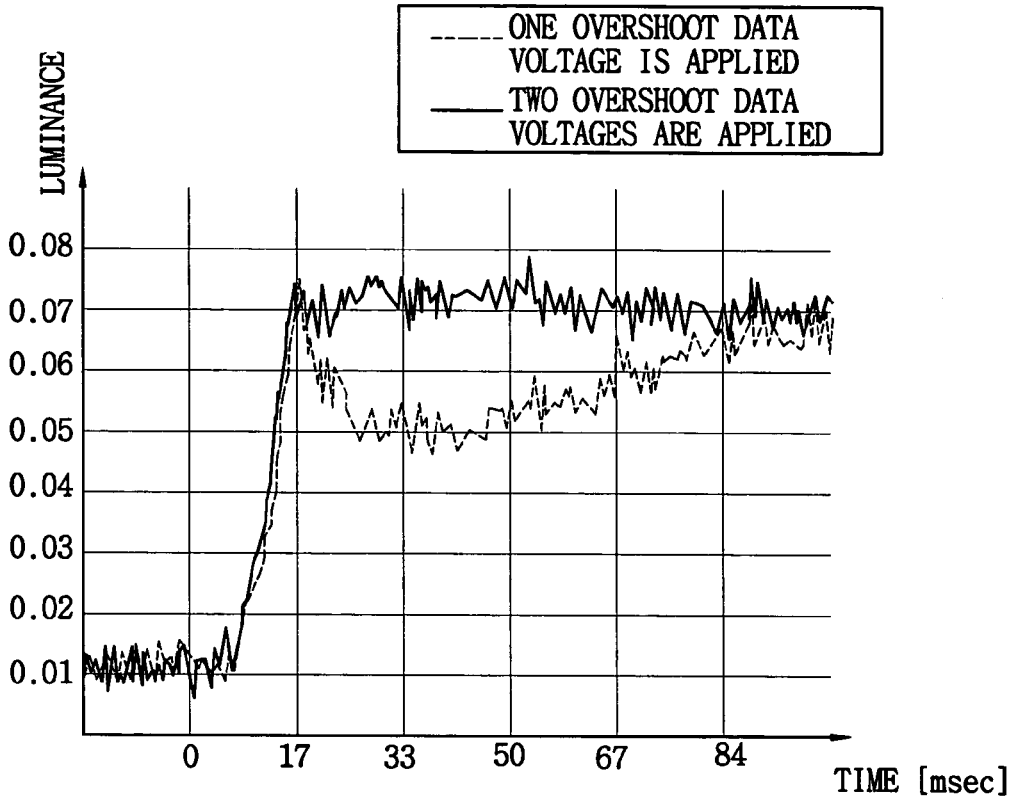
FIG. 9 is an experimental graph showing the luminance of an LCD apparatus having 64 levels of grayscale, according to an exemplary embodiment of the present invention.

FIG. 9 is an experimental graph showing the luminance of an LCD apparatus at a middle level of 64-level grayscale according to the present invention. In FIG. 9, a dotted line illustrates the luminance of an LCD apparatus in which only one overshoot data voltage is applied to pixel electrodes in response to the change of the grayscale data, and a solid line illustrates the luminance of an LCD apparatus in which two overshoot data voltage are applied to the pixel electrodes in response to the change of the grayscale data.

When a level of grayscale data is changed from 10th level to 60th level, the luminance of the LCD apparatus of the dotted line drops after rapidly increasing. However, the luminance of the LCD apparatus of the solid line does not drop after rapidly increasing due to the consecutive applying of two overshoot data voltages. Thus, the image blinking is not appeared in the LCD apparatus.

Figure 10:
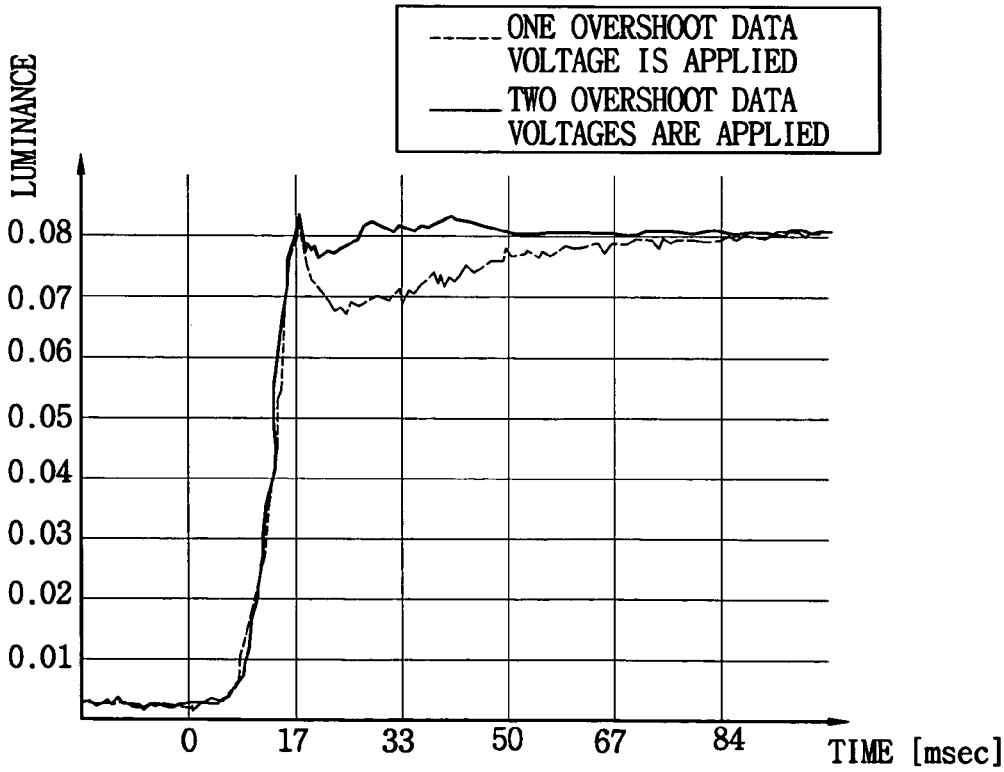
FIG. 10 is an experimental graph showing the luminance of an LCD apparatus having 128 levels of grayscale, according to an exemplary embodiment of the present invention.

FIG. 10 is an experimental graph showing the luminance of an LCD at a middle level of 128-level grayscale according to the present invention. In FIG. 10, a dotted line illustrates the luminance of an LCD apparatus in which only one overshoot data voltage is applied to pixel electrodes in response to the change of the grayscale data, and a solid line illustrates the luminance of an LCD apparatus in which two overshoot data voltage are applied to the pixel electrodes during the change of the grayscale data.

When a level of grayscale data is changed from 10th level to 120th level, the luminance of the LCD apparatus of the dotted line drops after rapidly increasing, as shown in a dotted line. However, the luminance of the LCD apparatus of the solid line does not drop due to the consecutive applying of two overshoot data voltages. Thus, the image blinking does not appear in the LCD apparatus, resulting in improving the display quality.

Figure 11:
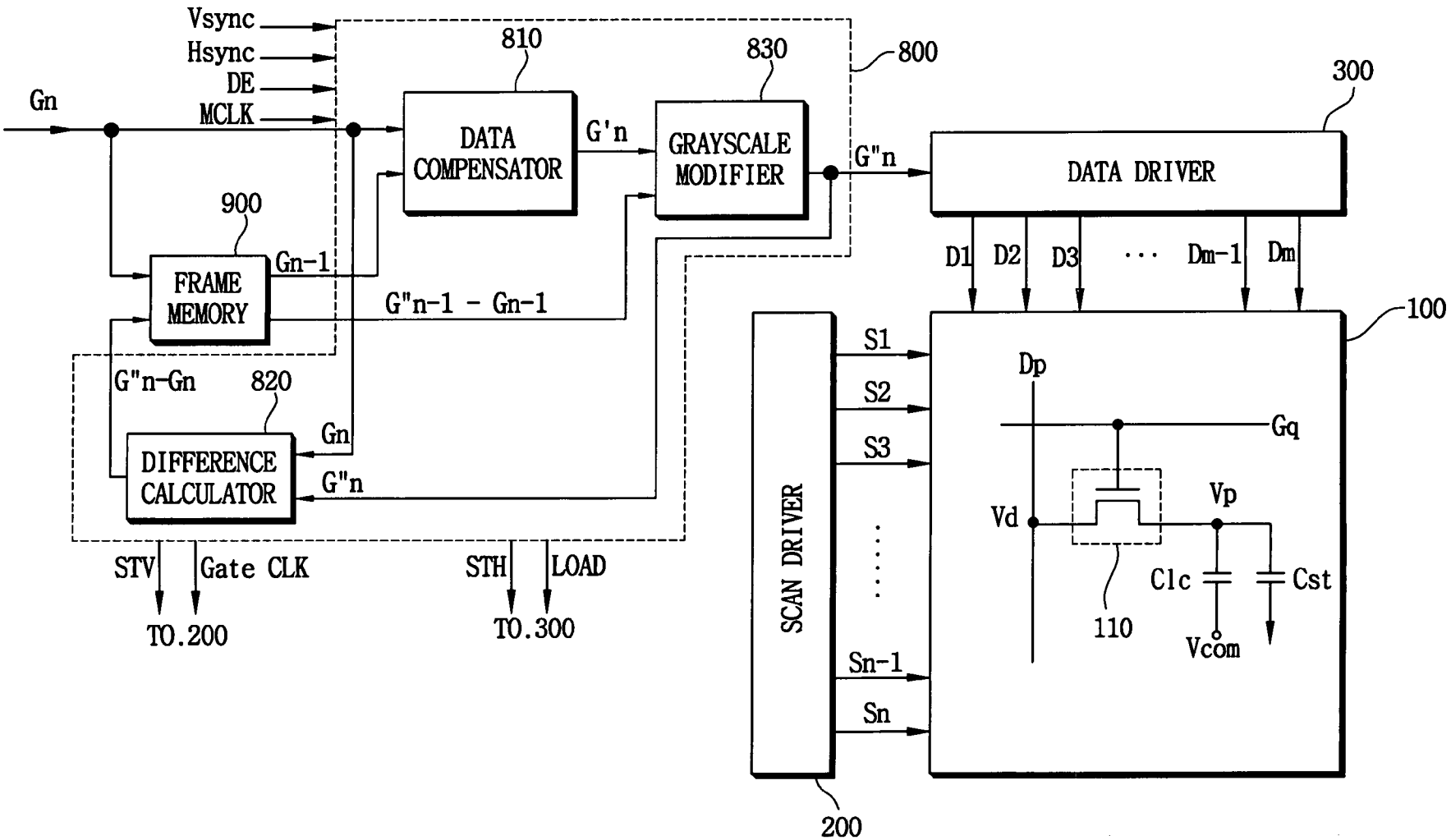
FIG. 11 is a block diagram of an LCD apparatus according to another exemplary embodiment of the present invention.

FIG. 11 is a block diagram of an LCD apparatus according another exemplary embodiment of the present invention. The same reference numerals are used to refer the same or like parts those described in FIG. 11 and any further explanation is omitted.

Referring to FIG. 11, an LCD apparatus includes an LC panel 100, a scan driver section 200, a data driver section 300, a timing controller 800, and a frame memory 900. The scan driver section 200, the data driver section 300 and the timing controller 800 modify and apply the grayscale data received from an external device, for example, a graphic controller, to the LC panel 100. The timing controller 800 may be embodied in a single unit or the timing controller 800 may be integrally formed with an external graphic card (not shown) or a data driver section 300.

The timing controller 800 includes a data compensator 810, a difference calculator 820 and a grayscale modifier 830. When the timing controller 800 receives the grayscale data Gn of a current frame, the timing controller 800 generates first compensated grayscale data G'n by using the grayscale data Gn-1 of a previous frame and the grayscale data Gn of the current frame. The timing controller 800 generates the data difference G"n−Gn between the grayscale data Gn of the current frame and the second compensated grayscale data G"n of the current frame. The timing controller 800 generates the second compensated grayscale data G"n by using the first compensated grayscale data G'n and data difference (G"n-1)−(Gn-1). The timing controller 800 provides the data driver 300 with the second compensated grayscale data G"n. The compensated grayscale data G"n optimizes a response time of LC molecules.

For example, when the grayscale data Gn-1 of the previous frame is the substantially same as the grayscale data Gn of the current frame, the grayscale data Gn of the current frame is not compensated. When the grayscale data Gn-1 of the previous frame has a lower level (for example, a black color) than the level (for example, a white color) of the grayscale data Gn of the current frame, the timing controller 800 outputs the second compensated grayscale data G"n that is higher than the grayscale data Gn of the current frame.

That is, the timing controller 800 outputs the second compensated grayscale data G"n as overshoot waveform.

The frame memory 900 stores the grayscale data Gn of the current frame and the data difference G"n−Gn between the grayscale data Gn of the current frame and the second compensated grayscale data G"n of the current frame. The grayscale data Gn is x-bit data provided from an external device. The data difference G"n−Gn is y-bit data generated from the difference calculator 820. The frame memory 900 provides the data compensator 810 with the previously stored grayscale data Gn-1 of the previous frame in response to a control signal of a controller (not shown). The frame memory 900 includes, for example, a SDRAM, which outputs the grayscale data Gn-1 of the previous frame in response to the input of the grayscale data Gn of the current frame.

The data compensator 810 generates the first compensated grayscale data G'n by using the grayscale data Gn-1 of the previous frame that is stored in the frame memory 900 and the grayscale data Gn of the current frame received from the external device. The data compensator 810 provides the grayscale modifier 830 with the first compensated grayscale data G'n. The data compensator 810 includes, for example, a look-up table for storing the compensated grayscale data corresponding to the difference of grayscale data between frames.

The difference calculator 820 generates the data difference G"n−Gn between the second compensated grayscale data G"n of the current frame and the grayscale data Gn of the current frame. The difference calculator 820 provides the frame memory 900 with the data difference G"n−Gn, which is stored in the frame memory 900.

The grayscale modifier 830 generates the second compensated grayscale data G"n by using the first compensated grayscale data G'n and the data difference (G"n-1)−(Gn-1). The grayscale modifier 640 provides the data driver 300 and the difference calculator 820 with the second compensated grayscale data G"n.

The timing controller 800 minimizes the number of frame memories as well as optimizes the response time of LC molecules. Assume that each grayscale data of red color, green color and blue color is 8-bit data (that is, the total bits of grayscale is 24 bits) and the frame memory 900 has a 32-bit data bus. In this case, the frame memory 900 has 8-bit as a surplus, and stores the data difference G'n−Gn as an 8-bit so as to enhance a process time.

For example, when each grayscale of red color, green color and blue color is x-bit data, the data difference G"n−Gn of each color is y-bit data (wherein y is an integer smaller than x). If the data difference G"n−Gn of the RGB is 8-bit data, the combination of the data difference G"n−Gn of the RGB includes, for example, 8-bit of (3, 3, 2), (3, 2, 3) or (2, 3, 3). The data difference G"n−Gn of the current frame corresponds to a most significant bit (MSB). Therefore, the timing controller 800 generates the second compensated grayscale data G"n by using one frame memory 900, which stores the grayscale data in one portion and stores the data difference in a remaining portion. Thus, the response time of the LC molecules is enhanced with a minimized number of the frame memories.

Figure 12A:
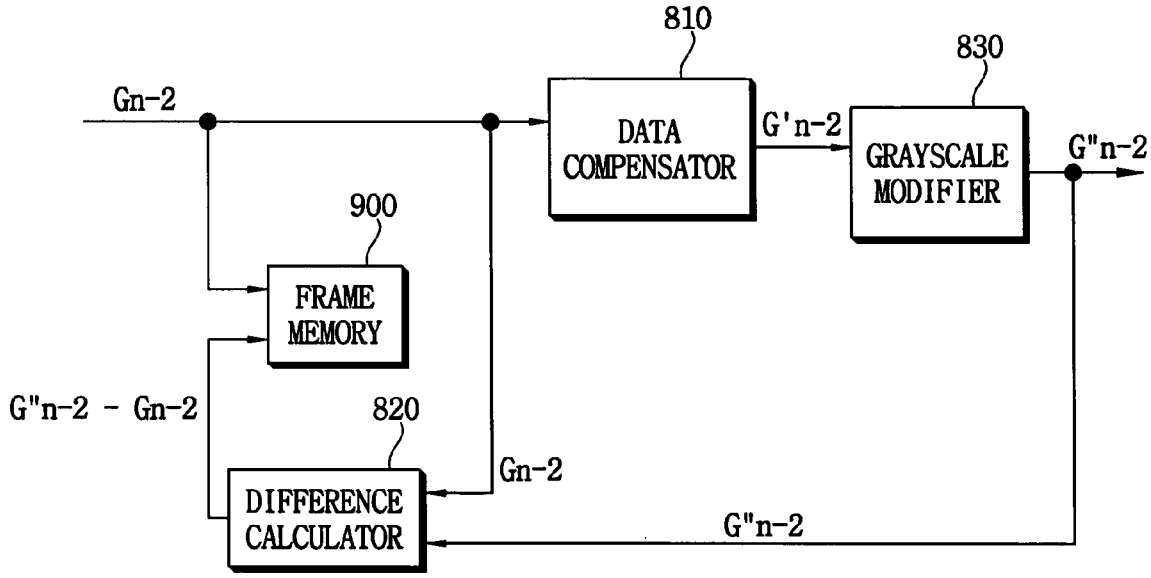
FIGS. 12A through 12C are block diagrams showing an operation of the timing controller of FIG. 11.
Figure 12B:
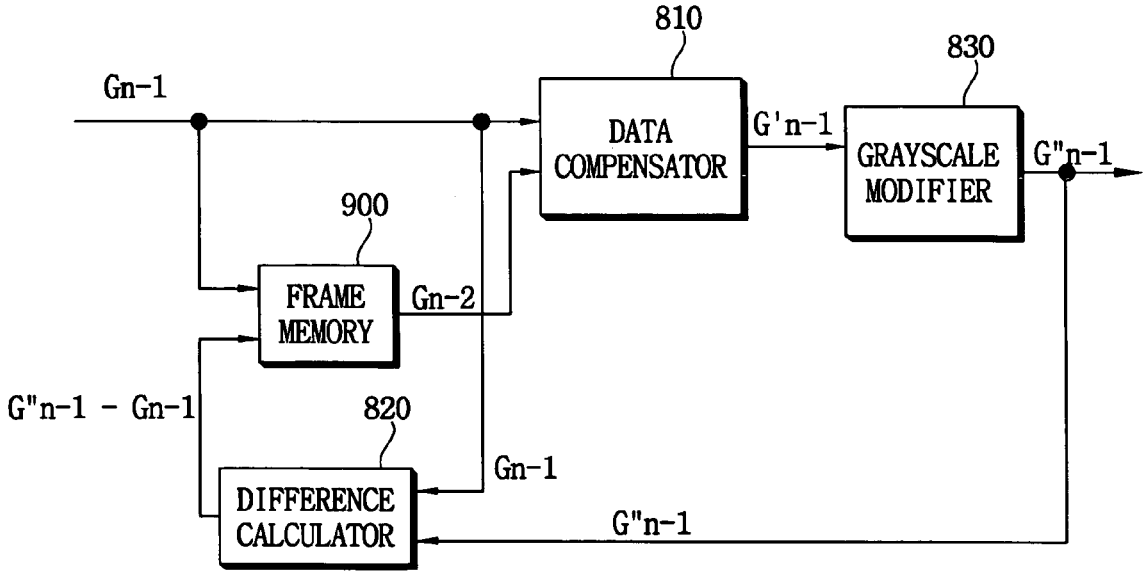
Figure 12C:
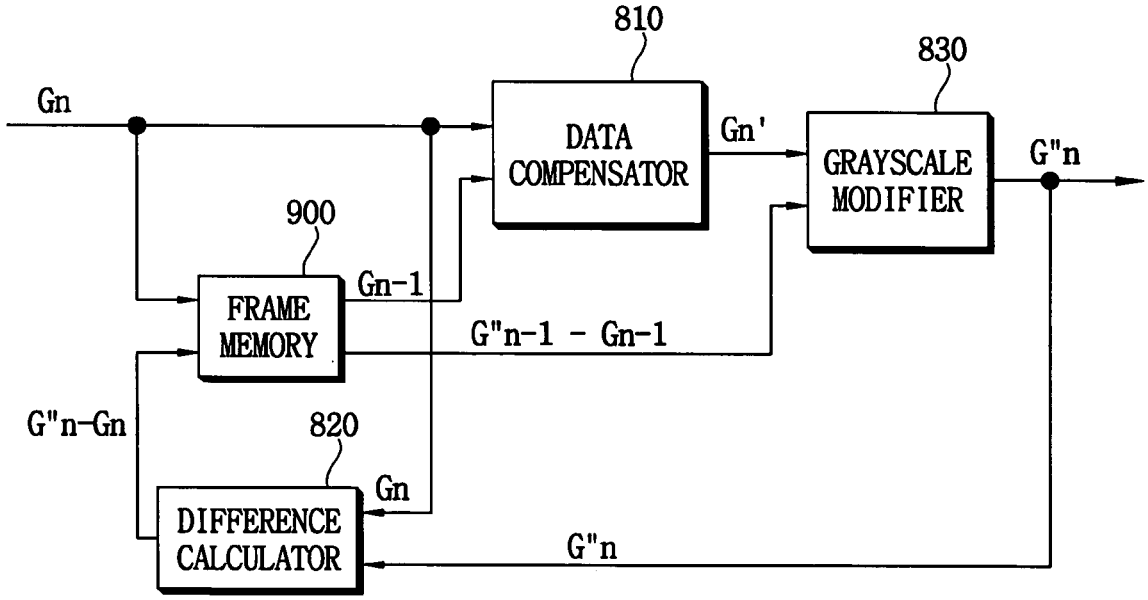

FIGS. 12A to 12C are block diagrams of an operation of the timing controller of FIG. 11. Referring to FIG. 12A, the grayscale data Gn-2 of a (n-2)-th frame is provided to a frame memory 900 and a data compensator 810 from an external device. The data compensator 810 generates and provides the first compensated grayscale data G'n-2 of the (n-2)-th frame to the grayscale modifier 830. The grayscale modifier 640 generates second compensated grayscale data G"n-2 in response to the first compensated grayscale data G'n-2. The first and second compensated grayscale data G'n-2 and G"n-2 is the same as the grayscale data of the (n-2)-th frame. That is, the grayscale data Gn-2 is not compensated at the (n-2)-th frame.

A difference calculator 820 receives the grayscale data Gn-2 of the (n-2)-th frame from the external device and the second compensated grayscale data G"n-2 of the (n-2)-th frame from the grayscale modifier 830. The difference calculator 820 calculates the data difference (G"n-2)−(Gn-2). The difference calculator 820 provides the frame memory 900 with the data difference (G"n-2)−(Gn-2), which is stored in the frame memory 900.

Referring to FIG. 12B, the grayscale data Gn-1 of a (n-1)-th frame is provided to the frame memory 900 and the data compensator 810. The frame memory 610 provides the data compensator 810 with the stored grayscale data Gn-2 of the (n-2)-th frame. The data compensator 810 generates the first compensated grayscale data G'n-1 of the (n-1)-th frame by using the grayscale data Gn-1 and the grayscale data Gn-2. The data compensator 810 provides the grayscale modifier 830 with the first compensated grayscale data G'n-1. The grayscale modifier 830 generates the second compensated grayscale data G"n-1 in response to the first compensated grayscale data G'n-1. The second compensated grayscale data G"n-1 is the same as the first compensated grayscale data G'n-1.

The difference calculator 820 receives the grayscale data Gn-1 of the (n-1)-th frame and the second compensated grayscale data G"n-1 of the (n-1)-th frame. The difference calculator 820 calculates the data difference (G"n-1)−(Gn-1). The difference calculator 820 provides the frame memory 900 with the data difference (G"n-1)−(Gn-1), which is stored in the frame memory 900.

Referring to FIG. 12C, the grayscale data Gn of an n-th frame is applied to the frame memory 900 and the data compensator 810. The frame memory 500 provides the data compensator 810 with the stored grayscale data Gn-1 of the (n-1)-th frame. The data compensator 810 generates the first compensated grayscale data G'n of the n-th frame by using the grayscale data Gn and the grayscale data Gn-1. The data compensator 810 provides the grayscale modifier 830 with the first compensated grayscale data G'n.

The difference calculator 630 receives the grayscale data Gn of the n-th frame and the second compensated grayscale data G"n of the n-th frame. The difference calculator 820 calculates the data difference G"n−Gn. The difference calculator 820 provides the frame memory 610 with the data difference G"n−Gn. The frame memory 900 stores the data difference G"n−Gn and provides the grayscale modifier 830 with the stored data difference (G'n-1)−(Gn-1).

The grayscale modifier 830 receives the first compensated grayscale data G'n and the data difference (G"n-1)−(Gn-1). The grayscale modifier 830 generates the compensated grayscale data G"n by using the first compensated grayscale data G'n and the data difference (G"n-1)−(Gn-1). The second compensated grayscale data G"n is provided to the data driver 300 of FIG. 11 and the difference calculator 820. When the data voltage corresponding to the second compensated grayscale data G"n is applied to the pixel electrode of the LC panel 100, a response time of LC molecules is enhanced.

Figure 13:
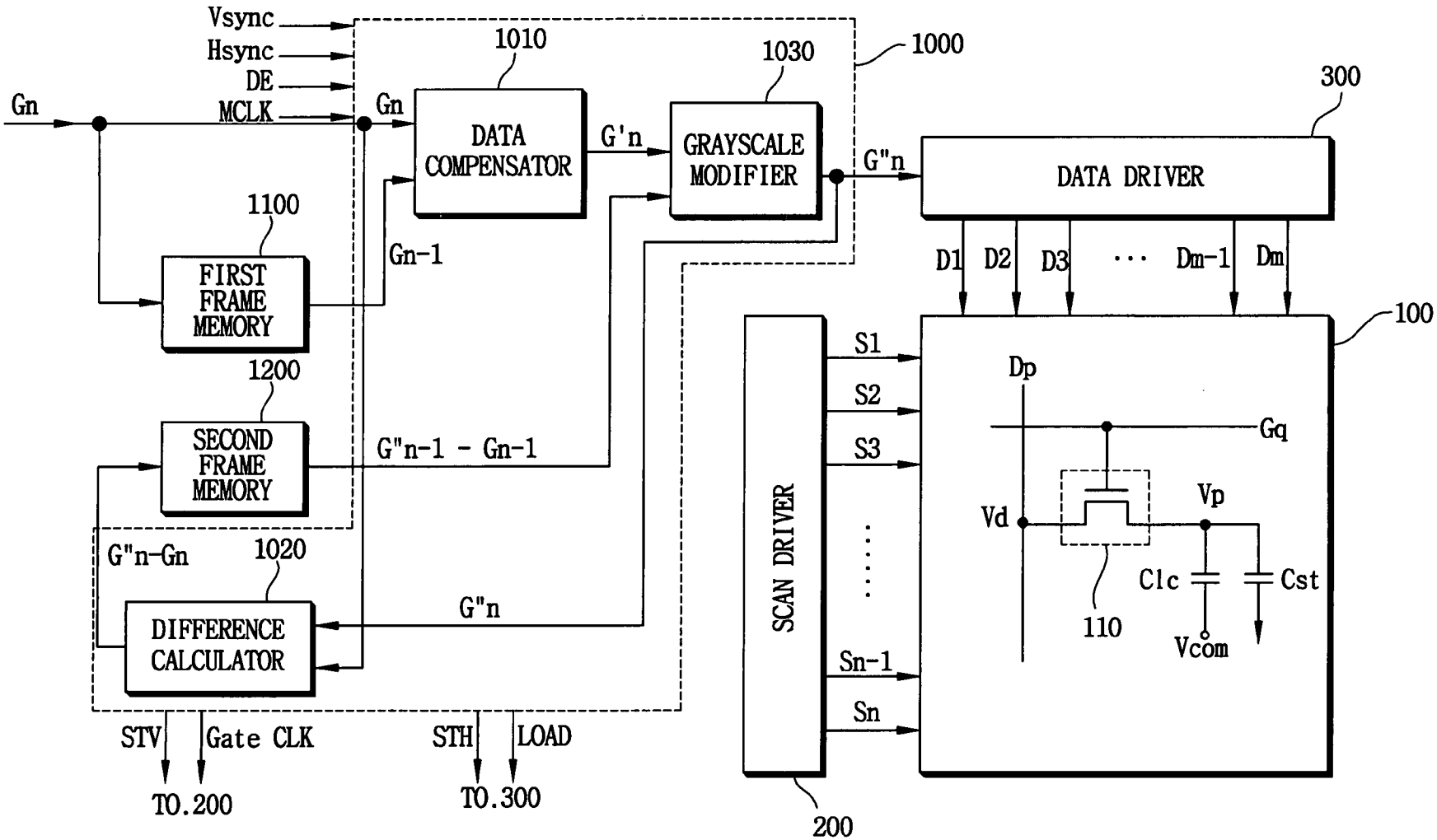
FIG. 13 is a block diagram of an LCD apparatus according to a further exemplary embodiment of the present invention.

FIG. 13 is a block diagram of an LCD apparatus according to a further exemplary embodiment of the present invention. The same reference numerals are used to refer the same or like parts those described in FIG. 11 and any further explanation is be omitted.

Referring to FIG. 13, an LCD apparatus includes an LC panel 100, a scan driver 200, a data driver 300, a timing controller 1000, and a first frame memory 1100, and a second frame memory 1200. The timing controller 1000 receives first timing signals 'Vsync', 'Hsync', 'DE' and 'MCLK' and provides the scan driver 200 and the data driver 300 with second timing signals 'Gate CLK' and 'STV' and third timing control signals 'LOAD' and 'STH', respectively. The scan and data drivers 200 and 300 drive the LC panel 100 together.

The timing controller 1000 includes a data compensator 1010, a difference calculator 1020 and a grayscale modifier 1030. When the timing controller 1000 receives the grayscale data Gn of a current frame, the timing controller 1000 generates the first compensated grayscale data G'n of the current frame by using the grayscale data Gn of the current frame and the grayscale data Gn-1 of a previous frame. The timing controller 1000 further generates the data difference G"n−Gn between the second compensated grayscale data G"n of the current frame and the grayscale data Gn of the current frame. The timing controller 1000 furthermore generates the second compensated grayscale data G"n by using the data difference (G"n-1)−(Gn-1) between the second compensated grayscale data G"n-1 of the previous frame and the grayscale data Gn-1 of the previous frame, and the first compensated grayscale data G'n of the current frame. The second compensated grayscale data G"n is transferred to the data driver section 300 and used to adjust the data voltage therein.

When the grayscale data Gn-1 of the previous frame is the substantially same as the grayscale data Gn of the current frame, the grayscale data Gn is not compensated. However, when the grayscale data Gn-1 of the previous frame has a lower level (for example, a black color) than a level (for example, a white color) of the grayscale data Gn of the current frame, the grayscale data Gn is compensated to be higher and the compensated grayscale data G"n is generated.

The first frame memory 1100 receives the grayscale data Gn of the current frame and stores the grayscale data Gn. In accordance with a controller (not shown), the first frame memory 1100 provides the data compensator 1010 with the previously grayscale data Gn-1 of the previous frame. For example, the first frame memory 1100 includes a SDRAM in which the stored grayscale data Gn-1 is outputted in response to the input of the grayscale data Gn.

The second frame memory 1200 receives the data difference G"n−Gn from the difference calculator 1020, and stores the data difference G"n−Gn therein. The second frame memory 1200 provides the grayscale modifier 1030 with the stored data difference (G"n-1)−(Gn-1) of the previous frame. The second frame memory 1200 includes, for example, a SDRAM in which the data difference (G"n-1)−(Gn-1) of the previous frame is outputted to the grayscale modifier 1030 in response to the input of the data difference G"n−Gn of the current frame.

The data compensator 1010 receives the grayscale data Gn of the current frame and the grayscale data Gn-1 of the previous frame. The data compensator 1010 generates the first compensated grayscale data G'n of the current frame using the grayscale data Gn of the current frame and the grayscale data Gn-1 of the previous frame. The first compensated grayscale data G'n is transferred to the grayscale modifier 1030.

The difference calculator 1020 receives the second compensated grayscale data G"n and the grayscale data Gn. The difference calculator 1020 generates the data difference G"n−Gn between the second compensated grayscale data G"n and the grayscale data Gn. The data difference G"n−Gn is transferred to the second frame memory 1200. The second frame memory 1200 stores the data difference G"n−Gn, and provides the grayscale modifier 1030 with the previous data difference (G"n-1)−(Gn-1).

The grayscale modifier 1030 receives the first compensated grayscale data G'n and the data difference (G"n-1)−(Gn-1). The grayscale modifier 1030 generates the second compensated grayscale data G"n using the first compensated grayscale data G'n and the data difference (G"n-1)−(Gn-1). The second compensated grayscale data G"n is transferred to the data driver 300.

Figure 14A:
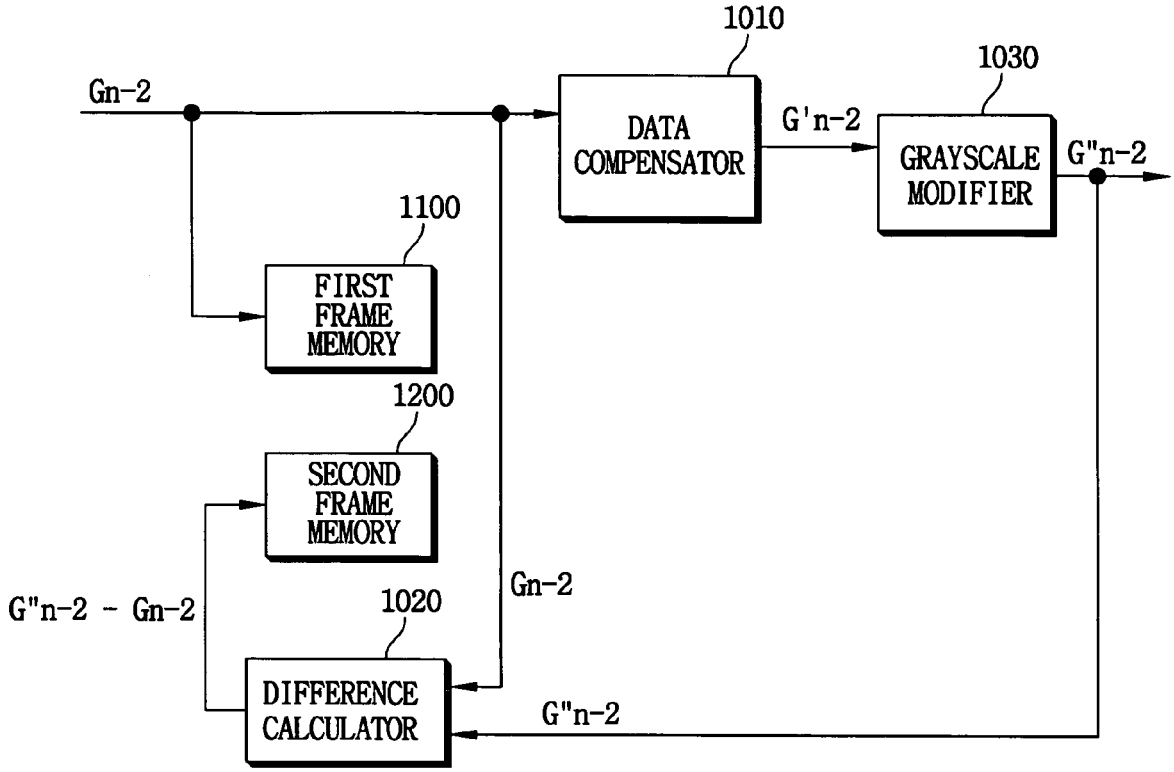
FIGS. 14A through 14C are block diagrams showing an operation of the timing controller of FIG. 13.
Figure 14B:
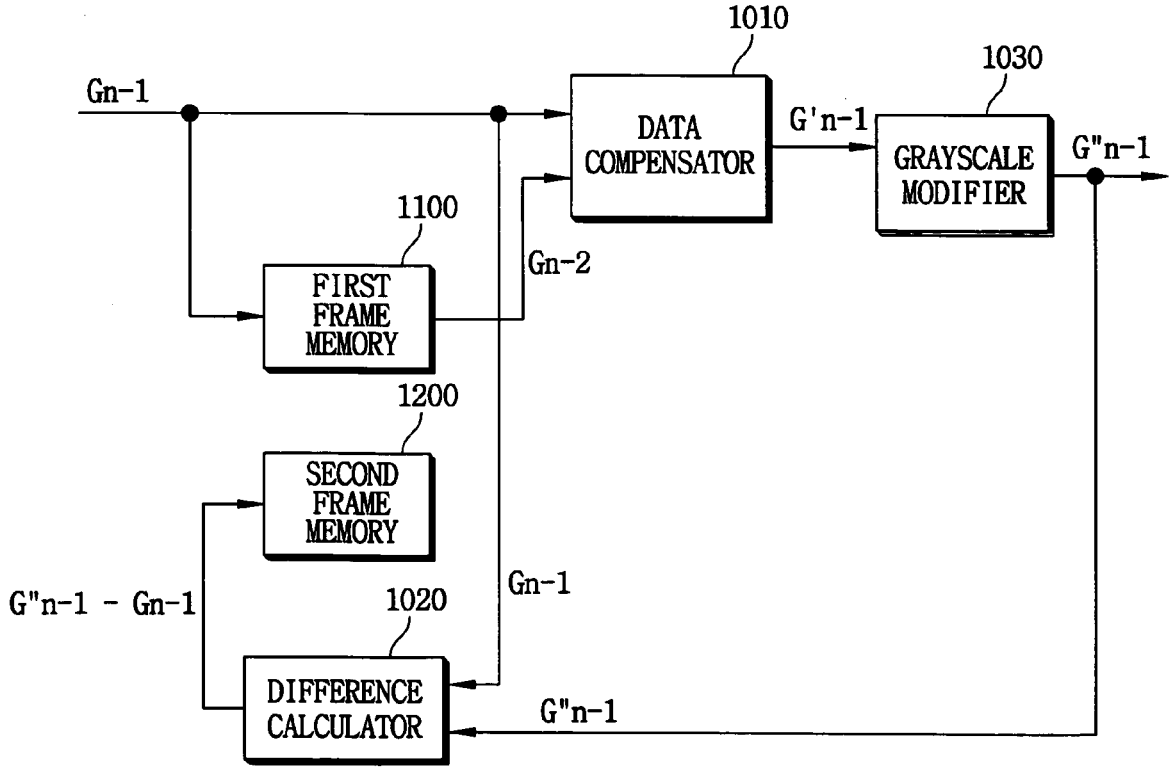
Figure 14C:
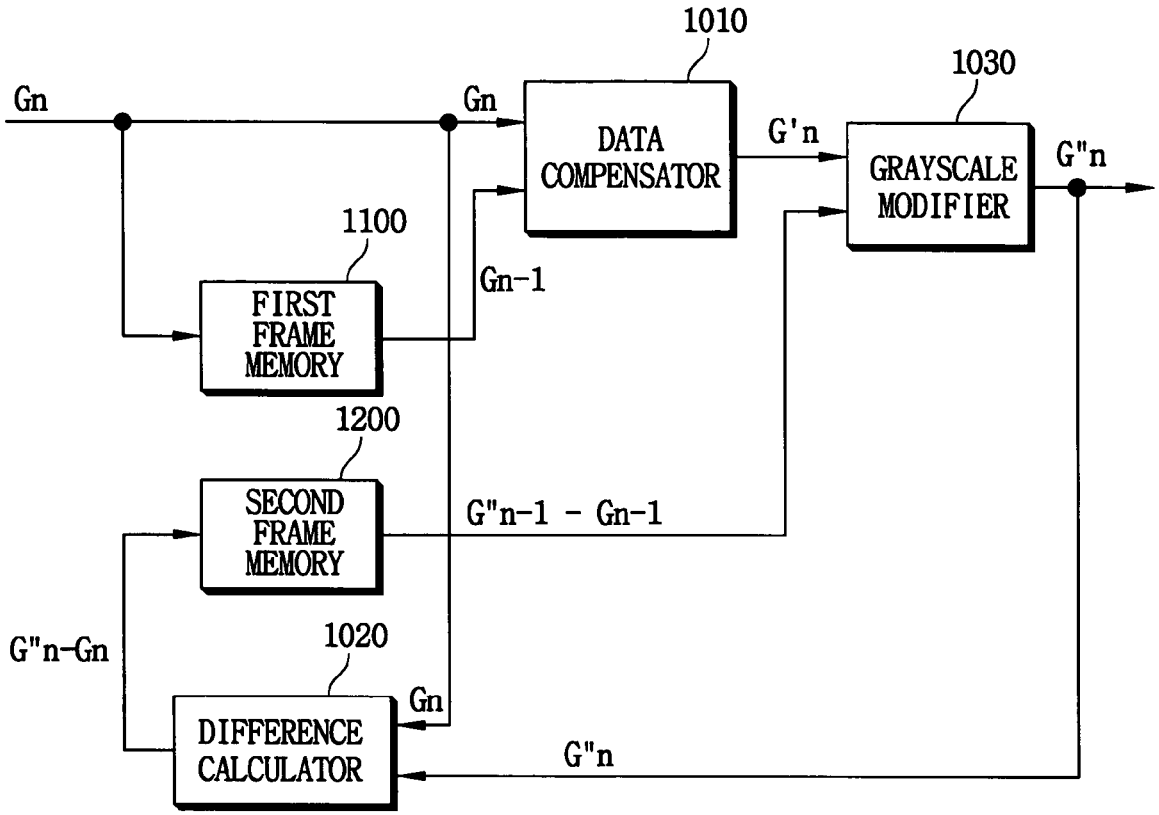

FIGS. 14A to 14C are block diagrams showing an operation of the timing controller of FIG. 13. Referring to FIG. 14A, the grayscale data Gn-2 of a (n-2)-th frame is applied to a first frame memory 1100 and a data compensator 1010 from an external device. The data compensator 1010 generates the first compensated grayscale data G'n-2 of the (n-2)-th frame and provides the grayscale modifier 1030 with the generated first compensated grayscale data G'n-2. The grayscale modifier 1030 generates the second compensated grayscale data G"n-2 in response to the first compensated grayscale data G'n-2. The first and second compensated grayscale data G'n-2 and G"n-2 is the same as the grayscale data Gn-2 at the (n-2)-th frame.

The difference calculator 1020 receives the grayscale data Gn-2 of the (n-2)-th frame from the external device and the second compensated grayscale data G"n-2 of the (n-2)-th frame from the grayscale modifier 1030. The difference calculator 1020 calculates the data difference (G"n-2)−(Gn-2) between the received grayscale data. The difference calculator 1020 provides a second frame memory 1200 with the data difference (G"n-2)−(Gn-2), which is stored in the second frame memory 1200.

Referring to FIG. 14B, the grayscale data Gn-1 of a (n-1)-th frame is applied to the first frame memory 1100 and the data compensator 1010 from the external device. The data compensator 1010 generates the first compensated grayscale data G'n-1 of the (n-1)-th frame by using the grayscale data Gn-1 received from the external device and the grayscale data Gn-2 of the (n-2)-th frame received from the first frame memory 1100. The generated first compensated grayscale data G'n-1 is provided to the grayscale modifier 1030. In response to the first compensated grayscale data G'n-1, the grayscale modifier 1030 generates the second compensated grayscale data G"n-1, which is the same to the first compensated grayscale data G'n-1.

The difference calculator 1020 receives the grayscale data Gn-1 of the (n-1)-th frame from the external device and the second compensated grayscale data G"n-1 of the (n-1)-th frame from the grayscale modifier 1030, and calculates the data difference (G"n-1)−(Gn-1) between the received grayscale data. The difference calculator 1020 provides the second frame memory 1200 with the data difference (G"n-1)−(Gn-1), which is stored in the second frame memory 1200.

Referring to FIG. 14C, the grayscale data Gn of an n-th frame is applied to the first frame memory 1100 and the data compensator 1010 from the external device. The first frame memory 1100 provides the data compensator 1010 with the stored grayscale data Gn-1 of the (n-1)-th frame, in response to the input of the grayscale data Gn. The data compensator 1010 generates the first compensated grayscale data G'n of the n-th frame using the grayscale data Gn and the grayscale data Gn-1. The data compensator 1010 provides the grayscale modifier 1030 with the first compensated grayscale data G'n.

The difference calculator 1020 receives the grayscale data Gn of the n-th frame from the external device and the second compensated grayscale data G"n of the n-th frame from the grayscale modifier 1030. The difference calculator 1020 calculates the data difference G"n−Gn and provides the calculated data difference G"n−Gn to the second frame memory 1200. In response to the input of the data difference G"n−Gn, the second frame memory 1200 stores the data difference G"n−Gn and provides the grayscale modifier 1030 with the stored data difference (G"n-1)−(Gn-1).

The grayscale modifier 1030 receives the first compensated grayscale data G'n and the data difference (G"n-1)−(Gn-1) and generates the second compensated grayscale data G"n, using the first compensated grayscale data G'n and the data difference (G"n-1)−(Gn-1). The compensated grayscale data G"n is provided to the data driver 300 of FIG. 13 and the difference calculator 1020. The second compensated grayscale data G"n is used to produce compensated data voltage, which is applied to a pixel electrode. Thus, a response time of liquid crystal molecules is enhanced.

Figure 15:
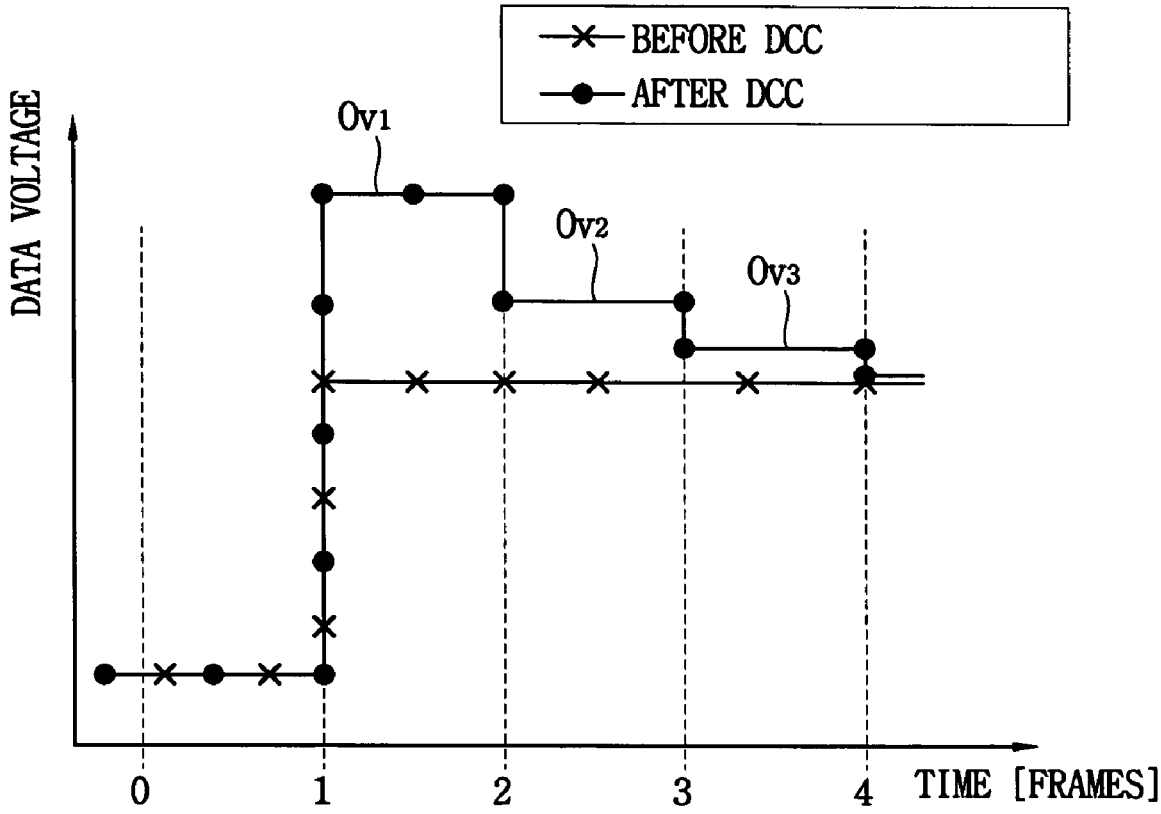
FIG. 15 is a graph showing the data voltage of an LCD before and after performing DCC, according to another exemplary embodiment of the present invention.

FIG. 15 is a graph showing the data voltage of an LCD apparatus before and after performing DCC according to another exemplary embodiment of the present invention. In FIG. 15, an "x" marked line indicates the data voltage of an LCD apparatus performing no DCC and a "•" marked line indicates the data voltage of an LCD apparatus performing DCC according to another exemplary embodiment of the present invention.

When a low level of grayscale data at a first frame is changed to a high level of grayscale data at a second frame, a first overshoot data voltage Ov1, which is the difference between the grayscale data of the first and second frames, is applied to a pixel electrode during the second frame. A second overshoot data voltage Ov2, which is the difference between the first overshoot data voltage Ov1 and the grayscale data of the second frame, is applied to the pixel electrode during a third frame. A third overshoot data voltage (Ov3), which is a difference of the second over shoot data voltage Ov2 and the grayscale data of the third frame, is applied to the pixel electrode during a fourth frame. The magnitude of the overshoot data voltages is decreased as the frames are passed.

Since three overshoot data voltages are consecutively applied to the pixel. electrodes of the LC panel 100, a luminance does not drop, resulting in improving of a display quality. Particularly, the first overshoot data voltage Ov1 rearranges LC molecules rapidly, and the second and third overshoot data voltages Ov2 and Ov3 prevent the LC molecules from returning to an original arrangement. Thus, a luminance reaches to a target level even at the first frame. Further, since the complete data difference is stored and used to generate the overshoot data voltages, the display quality is further enhanced.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A liquid crystal display apparatus, comprising:

a timing controller to generate a plurality of compensated grayscale data;

a memory to store at least grayscale data;

a column driver to apply the compensated grayscale data to a plurality of data lines;

a gate driver to apply a gate signal to a plurality of gate lines; and a liquid crystal panel including the gate lines, the data lines and a plurality of switching elements disposed between the data lines and the gate lines;

wherein the timing controller comprises:

a data compensator to generate current frame first compensated grayscale data in response to receiving previous frame grayscale data from the memory and current frame grayscale data from an external source;

a difference calculator to calculate a data difference between the current frame first compensated grayscale data and the current frame grayscale data, the difference calculator receiving the current frame first compensated grayscale data from the data compensator; and a grayscale modifier to generate current frame second compensated grayscale data in response to receiving the current frame first compensated grayscale data from the data compensator and the data difference of the previous frame compensated grayscale data and the previous frame grayscale data from the frame memory.

2. The liquid crystal display apparatus according to claim 1, wherein the memory includes at least one frame memory for receiving and storing both the current frame grayscale data and the data difference between the current frame first compensated grayscale data and the current frame grayscale data.

3. The liquid crystal display apparatus according to claim 2, wherein the frame memory stores the data difference between the current frame first compensated grayscale data and the current frame grayscale data, the data difference having a number of bits substantially smaller than a number of bits of the current frame grayscale data.

4. The liquid crystal display apparatus according to claim 2, wherein the at least one frame memory includes a synchronous dynamic random access memory (SDRAM) or Double Date Rate (DDR) memory.

5. The liquid crystal display apparatus according to claim 1, wherein the memory includes a first frame memory for receiving and storing current frame the grayscale data and a second frame memory for receiving and storing the data difference between the current frame first compensated grayscale data and the current frame grayscale data.

6. The liquid crystal display apparatus according to claim 5, wherein the first and second frame memories each include a synchronous dynamic random access memory (SDRAM) or Double Date Rate (DDR) memory.

7. The liquid crystal display apparatus according to claim 1, wherein the data compensator includes a look-up table.

8. The liquid crystal display apparatus according to claim 1, wherein the liquid crystal panel includes a Patterned Vertical Alignment mode liquid crystal panel.

9. The liquid crystal display apparatus according to claim 1, wherein the current frame first compensated grayscale data includes overshoot data or undershoot data.

10. A liquid crystal display apparatus comprising:

a timing controller to generate a plurality of compensated grayscale data;

a memory to store at least grayscale data;

a column driver to apply the compensated grayscale data to a plurality of data lines;

a gate driver to apply a gate signal to a plurality of gate lines; and a liquid crystal panel including the gate lines, the data lines and a plurality of switching elements disposed between the data lines and the gate lines;

wherein the timing controller comprises:

a data compensator to generate current frame first compensated grayscale data in response to receiving previous frame grayscale data from the memory and current frame grayscale data from an external source;

a grayscale modifier to generate current frame second compensated grayscale data in response to receiving the current frame first compensated grayscale data from the data compensator and a data difference between a previous frame second compensated grayscale data and a previous frame grayscale data, the data difference stored in the memory; and a difference calculator to calculate a data difference between the current frame second compensated grayscale data and the current frame grayscale data, the difference calculator receiving the current frame second compensated grayscale data from the grayscale modifier.

11. The liquid crystal display apparatus according to claim 10, wherein the data compensator includes a look-up table.

12. The liquid crystal display apparatus according to claim 10, wherein the current frame first compensated grayscale data includes overshoot data or undershoot data.

13. A method for driving a liquid crystal display apparatus, comprising:

generating current frame first compensated grayscale data in response to receiving previous frame grayscale data from a memory and current frame grayscale data received from an external source;

calculating a data difference between the current frame first compensated grayscale data and the current frame grayscale data;

generating current frame second compensated grayscale data in response to the current frame first compensated grayscale data and the data difference between the previous frame compensated grayscale data and the previous frame grayscale data;

storing the current frame grayscale data and the data difference in the memory;

applying a gate signal to gate lines;

applying a data voltage corresponding to the current frame second compensated grayscale data to data lines.

14. The method according to claim 13, wherein the current frame first compensated grayscale data includes overshoot data or undershoot data.

15. The method according to claim 13, wherein storing includes storing the current frame grayscale data and the data difference in the same memory.

16. The method according to claim 15, wherein the number of bits of the data difference is less than the number of bits of the current frame grayscale data.

17. The method according to claim 13, wherein storing includes storing the current frame grayscale data in a first memory and storing the data difference in a second memory.

18. A method for driving a liquid crystal display apparatus comprising:

generating current frame first compensated grayscale data in response to receiving previous frame grayscale data from a memory and current frame grayscale data received from an external source;

generating current frame second compensated grayscale data in response to the current frame first compensated grayscale data and a data difference between a previous frame compensated grayscale data and a previous frame grayscale data;

calculating a data difference between the current frame second compensated grayscale data and the current frame grayscale data;

storing the current frame grayscale data and the data difference between the current frame second compensated grayscale data and the current frame grayscale data in the memory;

applying a gate signal to gate lines;

applying a data voltage corresponding to the current frame second compensated grayscale data to data lines.

19. The method according to claim 18, wherein the current frame first compensated grayscale data includes overshoot data or undershoot data.

20. The method according to claim 18, wherein storing includes storing the current frame grayscale data and the data difference between the current frame second compensated grayscale data and the current frame grayscale data in the same memory.

21. The method according to claim 20, wherein the number of bits of the data difference between the current frame second compensated grayscale data and the current frame grayscale data is less than the number of bits of the current frame grayscale data.

22. The method according to claim 18, wherein storing includes storing the current frame grayscale data in a first memory and storing the data difference between the current frame second compensated grayscale data and the current frame grayscale in a second memory.

* * * * *